US011735113B2

(12) United States Patent
Dong

(10) Patent No.: US 11,735,113 B2
(45) Date of Patent: Aug. 22, 2023

(54) PIXEL DRIVING CIRCUIT, METHOD OF DRIVING THE SAME AND DISPLAY DEVICE

(71) Applicant: BOE Technology Group Co., Ltd., Beijing (CN)

(72) Inventor: Tian Dong, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/639,245

(22) PCT Filed: Apr. 15, 2021

(86) PCT No.: PCT/CN2021/087383
§ 371 (c)(1),
(2) Date: Feb. 28, 2022

(87) PCT Pub. No.: WO2021/233027
PCT Pub. Date: Nov. 25, 2021

(65) Prior Publication Data

US 2022/0375408 A1 Nov. 24, 2022

(30) Foreign Application Priority Data

May 20, 2020 (CN) ..... 202010430333.3

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0426* (2013.01);
(Continued)

(58) Field of Classification Search
CPC ..... G09G 3/3258; G09G 3/3233; G09G 2300/0426; G09G 2300/0819;
(Continued)

(56) References Cited

U.S. PATENT DOCUMENTS 10,504,436 B2 * 12/2019 He ..... G09G 3/3258
10,515,590 B2 * 12/2019 Yuan ..... G09G 3/3233
(Continued)

FOREIGN PATENT DOCUMENTS

CN 105427803 A 3/2016
CN 106710529 A 5/2017
(Continued)

OTHER PUBLICATIONS

CN 202010430333.3 first office action.
PCT/CN2021/087383 international search report and written opinion.

*Primary Examiner* — Tom V Sheng
(74) *Attorney, Agent, or Firm* — IPro, PLLC

(57) ABSTRACT

The present disclosure provides a pixel driving circuit, a method of driving the same, and a display device. In the pixel driving circuit, under the control of a gate line, a data writing-in sub-circuit controls to connect or disconnect a data line and a first common node, and controls to connect or disconnect the first common node and a gate electrode of the driving transistor; under the control of a reset signal line, a first reset control sub-circuit controls to connect or disconnect a reference voltage input terminal and a second common node, and controls to connect or disconnect the second common node and the gate electrode of the driving transistor; a first end of a third capacitor unit is connected to the first common node and/or the second common node, and a second end of the third capacitor unit is connected to the first electrode of the driving transistor.

15 Claims, 15 Drawing Sheets

(52) U.S. Cl.
CPC ..... *G09G 2300/0819* (2013.01); *G09G 2300/0852* (2013.01); *G09G 2310/0251* (2013.01); *G09G 2310/061* (2013.01); *G09G 2320/0233* (2013.01); *G09G 2320/0247* (2013.01); *G09G 2320/043* (2013.01)

(58) Field of Classification Search
CPC ..... G09G 2300/0852; G09G 2310/061; G09G 2310/0251; G09G 2320/0233; G09G 2320/0247; G09G 2320/043
USPC ..... 345/204
See application file for complete search history.

(56) References Cited

U.S. PATENT DOCUMENTS

| | | | | |
|---|---|---|---|---|
| 10,692,434 | B2 * | 6/2020 | Zhang | G09G 3/3266 |
| 11,361,713 | B1 * | 6/2022 | Fu | G09G 3/3241 |
| 2007/0247399 | A1 * | 10/2007 | Yamashita | G09G 3/3233 345/82 |
| 2009/0009441 | A1 * | 1/2009 | Yamamoto | G09G 3/3233 345/80 |
| 2009/0225011 | A1 * | 9/2009 | Choi | G09G 3/3233 345/76 |
| 2010/0127956 | A1 * | 5/2010 | Kang | G09G 3/3233 345/76 |
| 2011/0090200 | A1 * | 4/2011 | Choi | G09G 3/3233 345/76 |
| 2013/0099692 | A1 * | 4/2013 | Chaji | G09G 3/3233 315/224 |
| 2013/0100173 | A1 * | 4/2013 | Chaji | G09G 3/3275 345/76 |
| 2014/0070184 | A1 | 3/2014 | Shin | |
| 2014/0347405 | A1 | 11/2014 | Kumeta et al. | |
| 2016/0078808 | A1 * | 3/2016 | Lin | G09G 3/3233 345/690 |
| 2016/0322446 | A1 * | 11/2016 | Park | G09G 3/3266 |
| 2016/0372037 | A1 * | 12/2016 | Lim | H01L 27/3265 |
| 2017/0270853 | A1 | 9/2017 | Xiang et al. | |
| 2018/0190197 | A1 * | 7/2018 | Chang | G09G 3/3233 |
| 2018/0301092 | A1 | 10/2018 | Ma | |
| 2019/0148477 | A1 | 5/2019 | Park et al. | |
| 2019/0189053 | A1 * | 6/2019 | Kim | G09G 3/3266 |
| 2019/0295467 | A1 | 9/2019 | Lu et al. | |
| 2020/0320937 | A1 | 10/2020 | Yang et al. | |
| 2021/0174739 | A1 * | 6/2021 | Lu | G09G 3/3225 |
| 2022/0383813 | A1 * | 12/2022 | Wang | G09G 3/3233 |

FOREIGN PATENT DOCUMENTS

| | | | |
|---|---|---|---|
| CN | 108154845 | A | 6/2018 |
| CN | 108257549 | A | 7/2018 |
| CN | 110299108 | A | 10/2019 |
| CN | 110910825 | A | 3/2020 |
| CN | 111091783 | A | 5/2020 |
| CN | 111445856 | A | 7/2020 |
| CN | 111477179 | A | 7/2020 |

* cited by examiner

PIXEL DRIVING CIRCUIT, METHOD OF DRIVING THE SAME AND DISPLAY DEVICE

CROSS-REFERENCE TO RELATED APPLICATION

This application is the U.S. national phase of PCT Application No. PCT/CN2021/087383 filed on Apr. 15, 2021, which claims priorities of the Chinese patent application No. 202010430333.3 filed on May 20, 2020, which is incorporated herein by reference in its entity.

TECHNICAL FIELD

The present disclosure relates to the field of display technology, and more particularly to a pixel driving circuit, a method of driving the same and a display device.

BACKGROUND

Active-matrix Organic Light-Emitting Diode (AMOLED) display device has many advantages such as self-luminous, ultra-thin, fast response, high contrast, wide viewing angle, etc., and has received widespread attention.

The AMOLED display device includes a plurality of pixel driving circuits and a plurality of light-emitting elements, and the pixel driving circuit is used to drive the corresponding light-emitting element to emit light, thereby realizing the display function of the AMOLED display device. However, when the existing pixel driving circuit is driven at a low frequency, the gate electrode of the driving transistor in the pixel driving circuit has serious current leakage due to the long light-emitting time of the light-emitting element, and the display device is prone to flicker during display.

SUMMARY

The objective of the present disclosure is to provide a pixel driving circuit panel, a method of driving the same, and a display device.

In order to achieve the above object, the present disclosure provides the following technical solutions:

A first aspect of the present disclosure provides a pixel driving circuit for driving a light-emitting element, includes: a driving transistor, wherein a second electrode of the driving transistor is connected to the light-emitting element; a power control sub-circuit, respectively connected to a first control terminal, a power signal input terminal and a first electrode of the driving transistor; a data writing-in sub-circuit, respectively connected to a first common node, a gate line of a corresponding row, a data line of a corresponding column and a gate electrode of the driving transistor, and configured to, under the control of the gate line, control to connect or disconnect the data line and the first common node, and control to connect or disconnect the first common node and the gate electrode of the driving transistor; a first reset control sub-circuit, respectively connected to a second common node, a reset signal line, the gate electrode of the driving transistor and a reference voltage input terminal; configured to, under the control of the reset signal line, control to connect or disconnect the reference voltage input terminal and the second common node, and control to connect or disconnect the second common node and the gate electrode of the driving transistor; a first capacitor unit, wherein a first end of the first capacitor unit is connected to the gate electrode of the drive transistor, and a second end of the first capacitor unit is connected to the first electrode of the drive transistor; a second capacitor unit, wherein a first end of the second capacitor unit is connected to the first electrode of the driving transistor, and a second end of the second capacitor unit is connected to the power signal input end; and a third capacitor unit, a first end of the third capacitor unit is connected to the first common node and/or the second common node, and a second end of the third capacitor unit is connected to the first electrode of the driving transistor.

Optionally, the data writing-in sub-circuit includes a first double-gate transistor, and the first double-gate transistor includes a first sub-transistor and a second sub-transistor; a gate electrode of the first sub-transistor is connected to a gate electrode of the second sub-transistor, and is connected to the gate line of the corresponding row, and a first electrode of the first sub-transistor is connected to the data line of the corresponding column, a second electrode of the first sub-transistor is connected to the first common node; a first electrode of the second sub-transistor is connected to the first common node, and a second electrode of the second sub-transistor is connected to the gate electrode of the driving transistor.

Optionally, the first reset control sub-circuit comprises a second dual-gate transistor, and the second dual-gate transistor comprises a third sub-transistor and a fourth sub-transistor; a gate electrode of the third sub-transistor is connected to a gate electrode of the fourth sub-transistor and is connected to the reset signal line, and a first electrode of the third sub-transistor is connected to the reference voltage input terminal, a second electrode of the third sub-transistor is connected to the second common node; a first electrode of the fourth sub-transistor is connected to the second common node, and a second electrode of the fourth sub-transistor is connected to the gate electrode of the driving transistor.

Optionally, the pixel driving circuit further includes: a second reset control sub-circuit, respectively connected to the reset signal line, the second electrode of the driving transistor and the reference voltage input terminal; configured to, under the control of the reset signal line, control to connect or disconnect the reference voltage input terminal and the second electrode of the driving transistor.

Optionally, the second reset control sub-circuit includes a fifth transistor, a gate electrode of the fifth transistor is connected to the reset signal line, a first electrode of the fifth transistor is connected to the reference voltage input terminal, and a second electrode of the fifth transistor is connected to the second electrode of the driving transistor.

Optionally, the pixel driving circuit further includes: a third reset control sub-circuit, respectively connected to the reset signal line, the second electrode of the driving transistor and the initialization voltage input terminal; configured to, under the control of the reset signal line, control to connect or disconnect the initialization voltage input terminal and the second electrode of the driving transistor.

Optionally, the third reset control sub-circuit includes a fifth transistor, a gate electrode of the fifth transistor is connected to the reset signal line, a first electrode of the fifth transistor is connected to the initialization voltage input terminal, and a second electrode of the fifth transistor is connected to the second electrode of the driving transistor.

Optionally, the pixel driving circuit further includes a light-emitting control sub-circuit, and the second electrode of the driving transistor is connected to the light-emitting element through the light-emitting control sub-circuit; the light-emitting control sub-circuit is respectively connected to the first control terminal, the second electrode of the driving transistor and the light-emitting element, and is configured to connect or disconnect the second electrode of the driving transistor and the light emitting element under the control of the first control terminal.

Optionally, the light-emitting control sub-circuit includes a sixth transistor, a gate electrode of the sixth transistor is connected to the first control terminal, and a first electrode of the sixth transistor is connected to the second electrode of the driving transistor, and a second electrode of the sixth transistor is connected to the light emitting element.

Optionally, the power control sub-circuit includes a seventh transistor, a gate electrode of the seventh transistor is connected to the first control terminal, and a first electrode of the seventh transistor is connected to the power signal line input terminal, and a second electrode of the seventh transistor is connected to the first electrode of the driving transistor.

A second aspect of the present disclosure provides a display device comprising the pixel driving circuit.

Optionally, the display device further comprises a gate driving circuit, a reset signal control circuit, a plurality of gate lines and a plurality of reset signal lines; the gate driving circuit includes a plurality of first shift register units corresponding to the plurality of gate lines in a one-to-one manner, and each of the plurality of first shift register units is connected to a corresponding gate line, and is configured to provide a scan signal for the corresponding gate line; the reset signal control circuit includes a plurality of second shift register units corresponding to the plurality of reset signal lines in a one-to-one manner, and each of the plurality of second shift register units is connected to a corresponding reset signal line, and is configured to provide a reset signal to the corresponding reset signal line.

A third aspect of the present disclosure provides a method of driving a pixel driving circuit, wherein the method includes: in each working cycle, during a reset period, the power supply signal input terminal inputs a power supply voltage Vdd, and under the control of the first control terminal, the power supply control sub-circuit controls to connect the power supply signal input terminal and the first electrode of the driving transistor, the reference voltage input terminal inputs a reference voltage Vref, and under the control of the corresponding reset signal line, the first reset control sub-circuit controls to connect the reference voltage input terminal and the second common node, and controls to connect the second common node and the gate electrode of the driving transistor, so that the driving transistor is in an on state; during a threshold compensation period, under the control of the first control terminal, the power control sub-circuit controls to disconnect the power signal input terminal from the first electrode of the driving transistor, so that the driving transistor is changed from the on state to an off state, a potential of the first electrode of the driving transistor changes from Vdd to Vref-Vth, wherein Vth is a threshold voltage of the driving transistor; during a data writing-in period, under the control of the reset signal line, the first reset control sub-circuit controls to disconnect the reference voltage input terminal from the second common node, and control to disconnect the second common node from the gate electrode of the driving transistor; the data line of corresponding column inputs the data voltage Vdata, and under the control of the gate line of the corresponding row, the data writing-in sub-circuit controls to connect the data line of the corresponding column and the first common node, and control to connect the first common node and the gate electrode of the driving transistor, so that a potential of the gate electrode of the driving transistor, a potential of the first common node and a potential of the second common node are all changed from Vref to Vdata, and a potential of the first electrode of the driving transistor is changed under a coupling action of a first capacitor unit, a second capacitor unit and a third capacitor unit; during a light-emitting period, the power signal input terminal inputs the power supply voltage Vdd, and under the control of the first control terminal, the power control sub-circuit controls to connect the power signal input terminal and the first electrode of the driving transistors, under the control of the gate line of corresponding row, the data writing-in sub-circuit controls to disconnect the data line of the corresponding column from the first common node, and control to disconnect the first common node from the gate electrode of the driving transistor, the potential of the gate electrode of the driving transistor, the potential of the first common node and the potential of the second common node are changed under the coupling control of the first capacitor unit, the second capacitor unit and the third capacitor unit, so that the driving transistor is turned on to drive light-emitting element to emit light.

Optionally, the display device to which the pixel driving circuit is applied further includes a gate driving circuit, a reset signal control circuit, a plurality of gate lines and a plurality of reset signal lines; the gate driving circuit includes a plurality of first shift register units corresponding to the plurality of gate lines in a one-to-one manner, and each of the plurality of first shift register units is connected to a corresponding gate line, and is configured to provide a scan signal for the corresponding gate line; the reset signal control circuit includes a plurality of second shift register units corresponding to the plurality of reset signal lines in a one-to-one manner, and each of the plurality of second shift register units is connected to a corresponding reset signal line, and is configured to provide a reset signal for the corresponding reset signal line; during the threshold compensation period, the first reset control sub-circuit controls to connect the reference voltage input terminal and the second common node, and controls to connect the second common node and the gate electrode of the driving transistors for a first time length; during the data writing-in period, the data writing-in sub-circuit controls to connect the data line of the corresponding column and the first common node, and controls to connect the first common node and the gate electrode of the driving transistor for a second time length; the first time length is greater than the second time length.

Optionally, the pixel driving circuit further includes a light-emitting control sub-circuit, and the second electrode of the driving transistor is connected to the light-emitting element through the light-emitting control sub-circuit; the light-emitting control sub-circuit is respectively connected to the first control terminal, the second electrode of the driving transistor and the light-emitting element; the method further includes: during the threshold compensation period and the data writing-in period, under the control of the first control terminal, the light-emitting control sub-circuit controls to disconnect the second electrode of the driving transistor from the light-emitting element, so that the light-emitting element does not emit light during the threshold compensation period and the data writing-in period.

BRIEF DESCRIPTION OF THE DRAWINGS

The drawings described here are used to provide a further understanding of the present disclosure and constitute a part of the present disclosure. The exemplary embodiments and descriptions of the present disclosure are used to explain the present disclosure, and do not constitute an improper limitation of the present disclosure.

DETAILED DESCRIPTION

In order to further illustrate the display panel, the manufacturing method thereof, and the display device provided by the embodiments of the present disclosure, a detailed description is given below with reference to the accompanying drawings.

Figure 1:
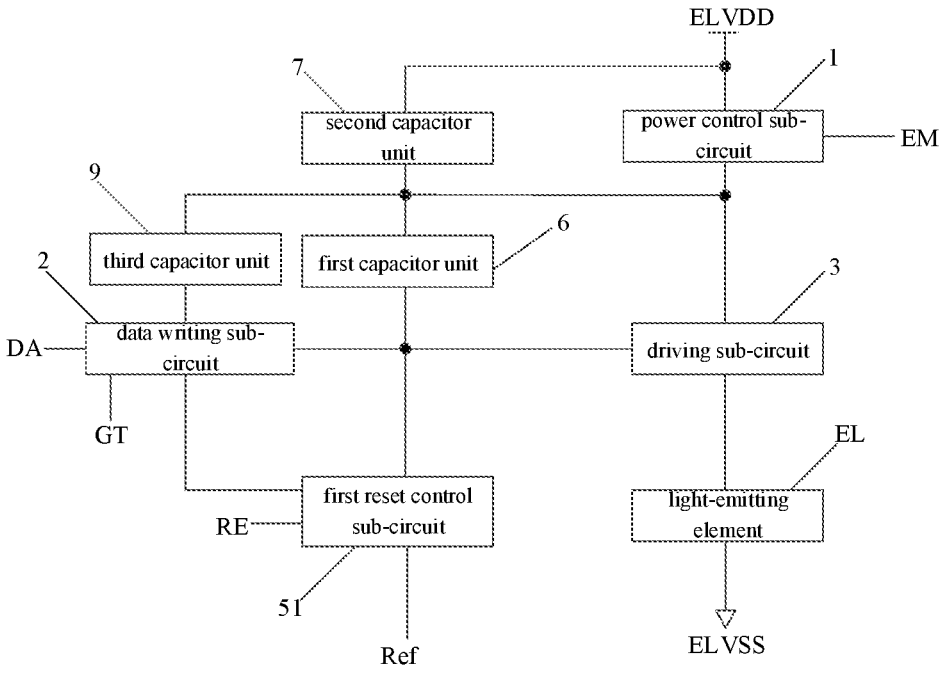
FIG. 1 is a schematic diagram of a first structure of a pixel driving circuit provided by an embodiment of the present disclosure.
Figure 2:
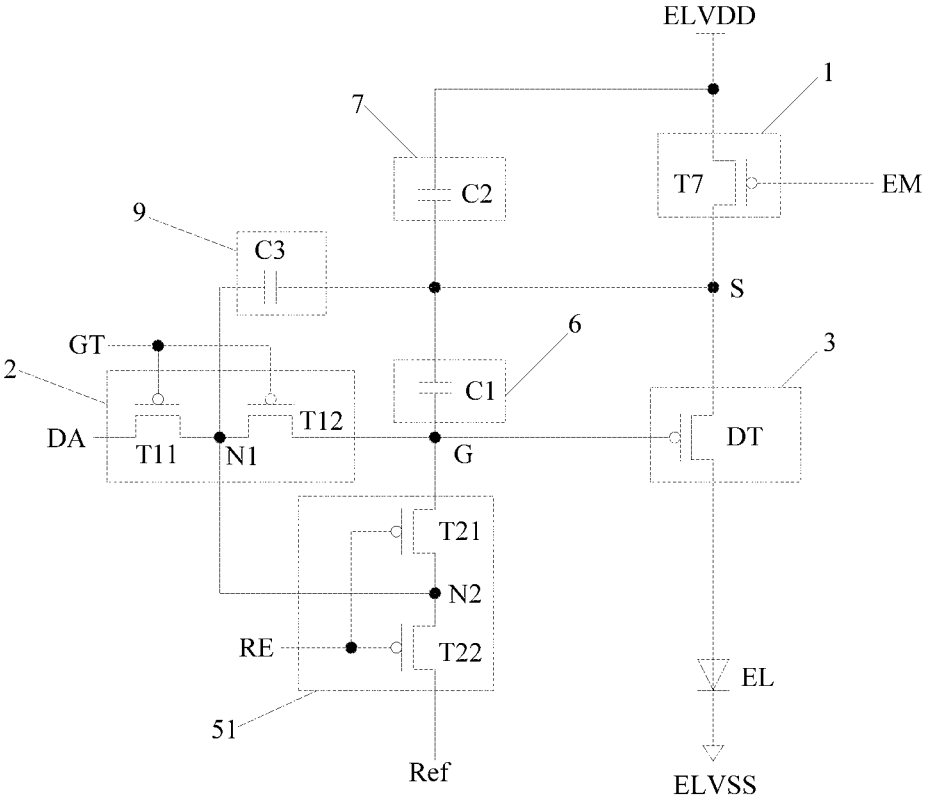
FIG. 2 is a first circuit diagram of a pixel driving circuit provided by an embodiment of the present disclosure.

Referring to FIG. 1 and FIG. 2, an embodiment of the present disclosure provides a pixel driving circuit for driving a light-emitting element EL, and the pixel driving circuit includes:

a driving transistor DT (i.e., a driving sub-circuit 3), a second electrode of the driving transistor DT is connected to the light-emitting element EL;

a power control sub-circuit 1, respectively connected to a first control terminal EM, a power signal input terminal ELVDD and a first electrode of the driving transistor DT;

a data writing sub-circuit 2, respectively connected to a first common node N1, a gate line GT in a corresponding row, a data line DA in a corresponding column and a gate electrode of the driving transistor DT, and configured to, under the control of the gate line GT, control to connect or disconnect the data line DA and the first common node N1, and control to connect or disconnect the first common node N1 and the gate electrode of the driving transistor DT;

a first reset control sub-circuit 51, respectively connected to a second common node N2, a reset signal line RE, the gate electrode of the driving transistor DT, and a reference voltage input terminal Ref; configured to, under the control of the reset signal line RE, control to connect or disconnect the reference voltage input terminal Ref and a second common node N2, and control to connect or disconnect the second common node N2 and the gate electrode of the driving transistor DT;

a first capacitor unit 6, a first end of the first capacitor unit 6 is connected to the gate electrode of the drive transistor DT, and a second end of the first capacitor unit 6 is connected to the first electrode of the drive transistor DT;

a second capacitor unit 7, a first end of the second capacitor unit 7 is connected to the first electrode of the driving transistor DT, and a second end of the second capacitor unit 7 is connected to the power signal input end ELVDD; and a third capacitor unit 9, a first end of the third capacitor unit 9 is connected to the first common node N1 and/or the second common node N2, and a second end of the third capacitor unit 9 is connected to the first electrode of the driving transistor DT.

Specifically, the pixel driving circuit is applied to a display device, and the display device includes a substrate, a plurality of pixel driving circuits arranged in an array on the substrate, and light-emitting elements EL arranged at a side of the plurality of pixel driving circuits away from the substrate and corresponding to the plurality of pixel driving circuits in a one-to-one manner. Exemplarily, the light-emitting element EL specifically includes an anode, a light-emitting functional layer, and a cathode that are sequentially stacked along a direction away from the substrate, and the anode of the light-emitting element EL can be connected to the corresponding pixel driving circuit and receive the driving signal provided by the corresponding pixel driving circuit, the cathode can be connected to a negative power supply signal line in the display device, receive a negative power supply signal provided by the negative power supply signal line, and the light-emitting functional layer is used to emit light under the action of the anode and the cathode.

Figure 3:
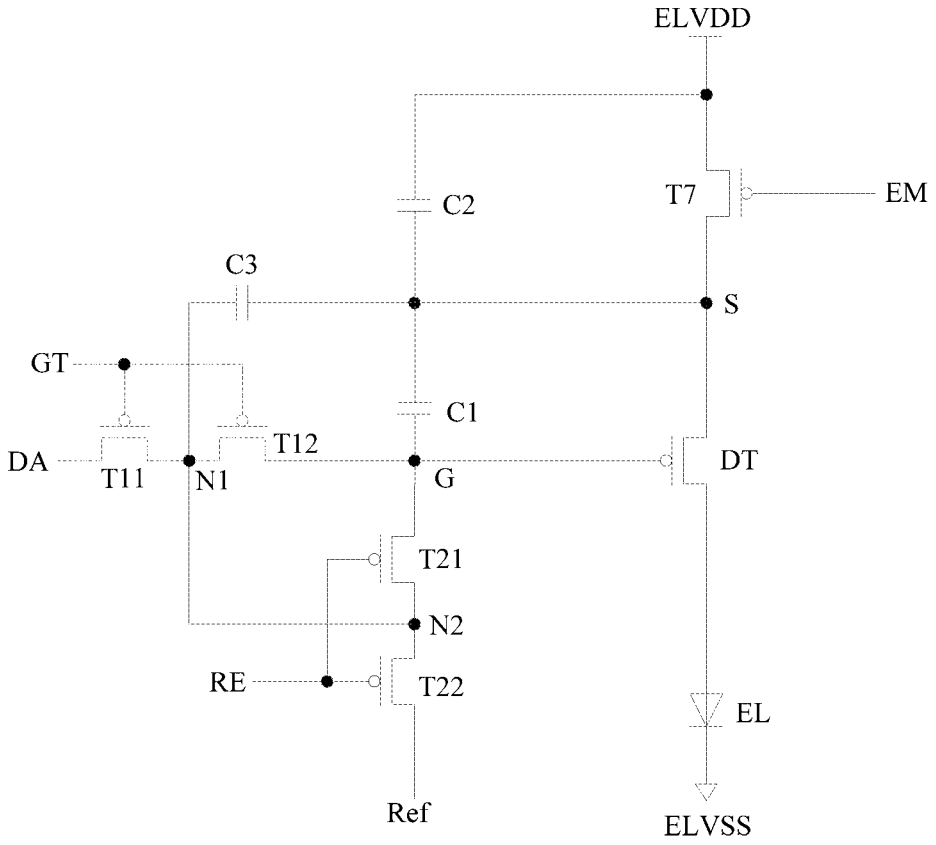
FIG. 3 is a schematic diagram of a working state of the pixel driving circuit in FIG. 2 during a reset period.

Please refer to FIG. 3 to FIG. 7. the working process of the above pixel driving circuit in one driving cycle is as follows:

In a reset period P1, as shown in FIG. 3, the power signal input terminal ELVDD inputs the power supply voltage Vdd, and under the control of the first control terminal EM, the power control sub-circuit 1 controls to connect the power signal input terminal ELVDD and the first electrode of the driving transistor DT (i.e., the nodes S), so that the potential of the first electrodes of the driving transistor DT becomes Vdd. The reference voltage input terminal Ref inputs the reference voltage Vref, under the control of the corresponding reset signal line RE, the first reset control sub-circuit 51 controls to connect the reference voltage input terminal Ref and the second common node N2, and controls to connect the second common node N2 and the gate electrode of the driving transistor DT (i.e., the node G), so that the potential of the second common node N2 and the potential of the gate electrode of the driving transistor DT both become Vref, so that the voltages of the gate electrode and the first electrode of the driving transistor DT are both in a fixed bias state, and the driving transistor DT is turned on to prepare for a threshold compensation period P2.

Therefore, in the reset period P1, both the potential of the second common node N2 and the potential of the gate electrode of the driving transistor DT can be changed to Vref, and the potential of the first electrode of the driving transistor DT can be changed to Vdd, thereby initializing the driving transistor DT.

It should be noted that, in the reset period P1, in order to turn on the driving transistor DT, the turn-on condition of the driving transistor DT should be satisfied, that is, Vref-Vdd should be less than the threshold voltage Vth of the driving transistor DT. In addition, exemplarily, the light-emitting element EL can be an OLED, the anode of the light-emitting element EL is the anode of the OLED, the cathode of the light-emitting element EL is the cathode of the OLED, and the cathode of the light-emitting element EL is connected to the low-level signal input terminal ELVSS, the low-level signal input terminal ELVSS can be connected to a negative power supply signal line for inputting a low-level signal.

Figure 4:
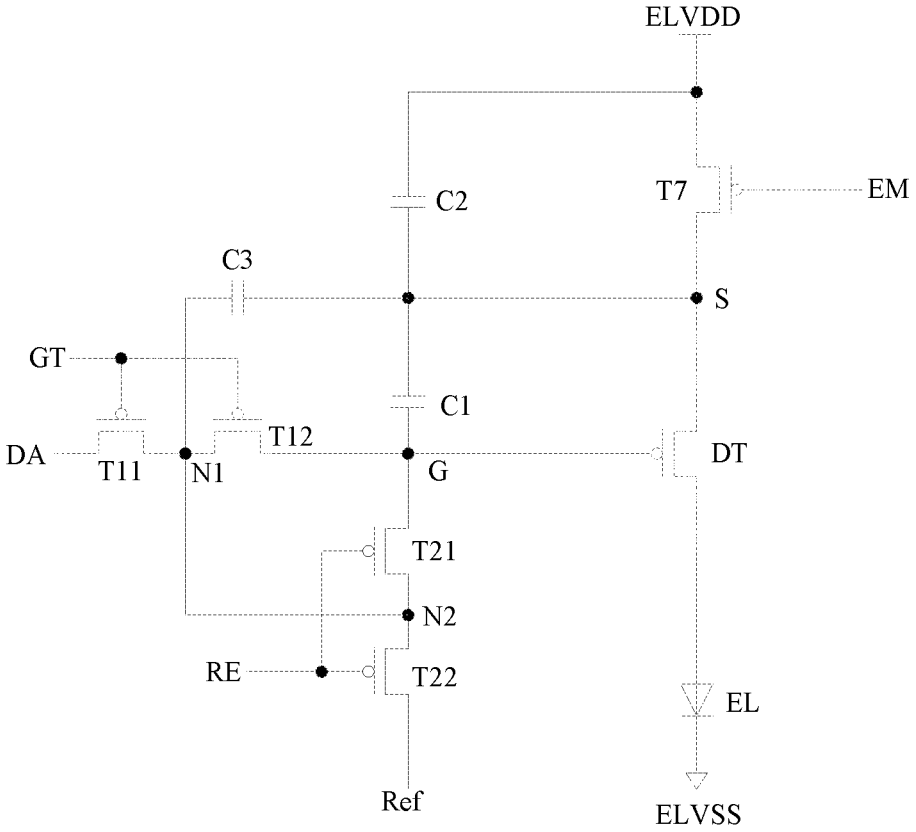
FIG. 4 is a schematic diagram of a working state of the pixel driving circuit in FIG. 2 during a threshold compensation period.

In the threshold compensation period P2, as shown in FIG. 4, the reference voltage input terminal Ref inputs the reference voltage Vref, and under the control of the corresponding reset signal line RE, the first reset control sub-circuit 51 continues to control to connect the reference voltage input terminal Ref and the second common node N2 and control to connect the second common node N2 and the gate electrode of the driving transistor DT, so that the potential of the second common node N2 and the potential of the gate electrode of the driving transistor DT are kept at Vref. Under the control of the first control terminal EM, the power control sub-circuit 1 controls to disconnect the power signal input terminal ELVDD from the first electrode of the driving transistor DT, so that the first electrode of the driving transistor DT is in a floating state, a discharge process is implemented on the driving transistor DT, and the driving transistor DT changes from the on state to the off state, so that the potential of the first electrode of the driving transistor DT changes from Vdd to Vref-Vth, and Vth is the threshold voltage of the driving transistor DT.

It should be noted that, during the threshold compensation period P2, when a discharge process is implemented on the driving transistor DT, the potential of the first electrode of the driving transistor DT starts to decrease from Vdd until it drops to Vref-Vth, a conduction condition of the driving transistor DT is not satisfied, so that the driving transistor DT is turned off.

Figure 5:
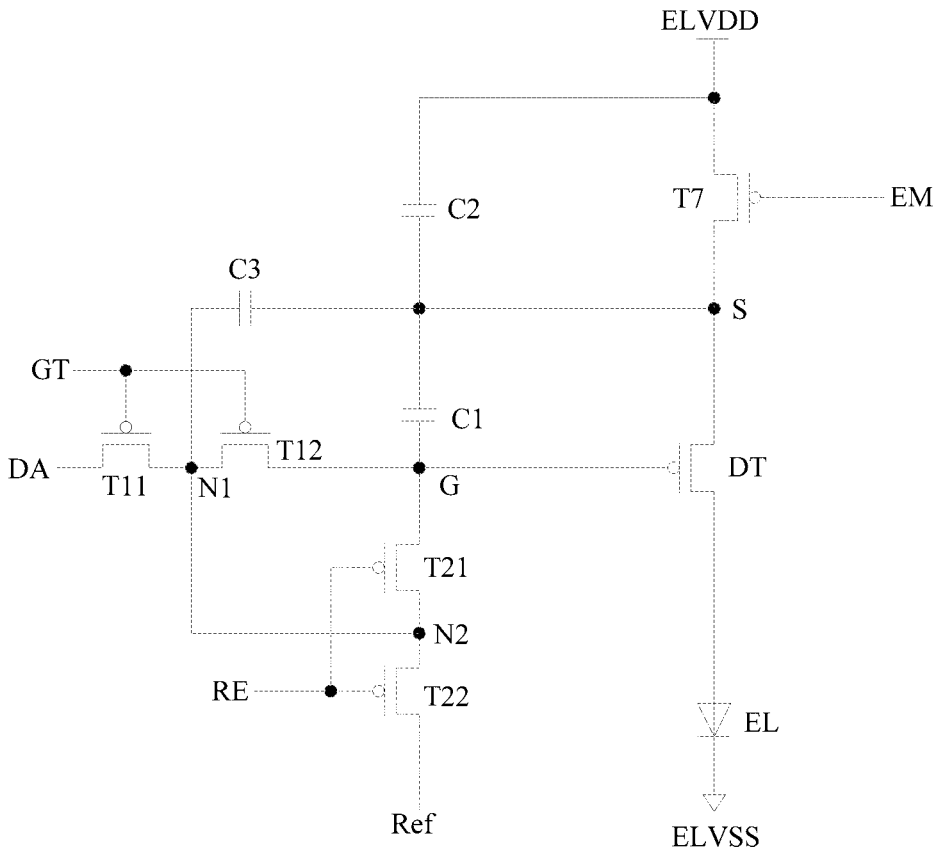
FIG. 5 is a schematic diagram of a working state of the pixel driving circuit in FIG. 2 during a data writing-in period.

During the data writing-in period P3, as shown in FIG. 5, under the control of the reset signal line RE, the first reset control sub-circuit 51 controls to disconnect the reference voltage input terminal Ref from the second common node N2, and control to disconnect the second common node N2 from the gate electrode of the driving transistor DT. Under the control of the first control terminal EM, the power control sub-circuit 1 continues to control to disconnect the power signal input terminal ELVDD from the first electrode of the driving transistor DT. The data line DA of the corresponding column inputs the data voltage Vdata, and under the control of the gate line GT of the corresponding row, the data writing-in sub-circuit 2 controls to connect the data line DA of the corresponding column and the first common node N1, and controls to connect the first common node N1 and the gate electrode of the driving transistor DT, so that the potential of the gate electrode of the driving transistor DT, the potential of the first common node N1 and the potential of the second common node N2 changes from Vref to Vdata. Under the coupling action of the first capacitor unit 6, the second capacitor unit 7 and the third capacitor unit 9, the potential of the first electrode of the driving transistor DT changes from Vref-Vth to [(C1+C3)/(C1+C2+C3)](Vdata-Vref)+Vref−Vth.

In more detail, when the potential of the gate electrode of the driving transistor DT changes from Vref to Vdata, the amount of change in the potential of the gate electrode of the driving transistor DT is Vdata-Vref. According to law of conservation of charge, the potential of the first electrode of the driving transistor DT becomes [C1+C3/(C1+C2+C3)](Vdata-Vref)+Vref−Vth.

It should be noted that C1 represents the capacitance value of the first capacitor included in the first capacitor unit 6, C2 represents the capacitance value of the second capacitor included in the second capacitor unit 7, and C3 represents the capacitance value of the third capacitor included in the third capacitor unit 9.

Figure 6:
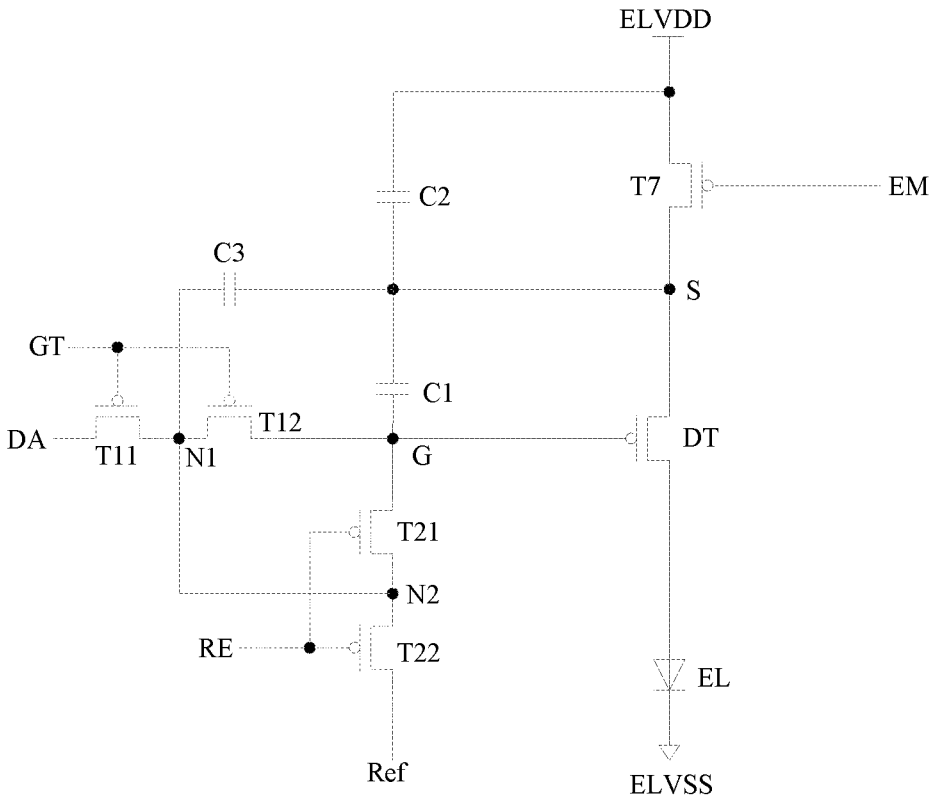
FIG. 6 is a schematic diagram of a working state of the pixel driving circuit in FIG. 2 during a light-emitting period.

During the light-emitting period P4, as shown in FIG. 6, under the control of the reset signal line RE, the first reset control sub-circuit 51 continues to control to disconnect the reference voltage input terminal Ref from the second common node N2 and control to disconnect the second common node N2 from the gate electrode of the driving transistor DT. The power supply signal input terminal ELVDD inputs a power supply voltage Vdd, and under the control of the first control terminal EM, the power supply control sub-circuit 1 controls to connect the power supply signal input terminal ELVDD and the first electrode of the first driving transistor DT, so that the potential of the first electrode of the driving transistor DT change from [C1+C3/(C1+C2+C3)](Vdata-Vref)+Vref−Vth to Vdd. Under the control of the gate line GT of the corresponding row, the data writing-in sub-circuit 2 controls to disconnect the data line DA from the first common node N1, and controls to disconnect the first common node N1 from the gate electrode of the driving transistor DT, under the coupling control of the first capacitor unit 6, the second capacitor unit 7 and the third capacitor unit 9, the potential of the gate electrode of the driving transistor DT, the potential of the first common node N1 and the potential of the second common node N2 are all changed from Vdata to [C2/(C1+C2+C3)](Vdata-Vref)+Vth+Vdd, so that the driving transistor DT is turned on to drive the light-emitting element EL to emit light.

In more detail, during the light-emitting period P4, the potential of the first electrode of the driving transistor DT changes from [(C1+C3)/(C1+C2+C3)](Vdata-Vref)+Vref−Vth to Vdd, the amount of the change of the potential of the first electrode of the driving transistor DT is Vdd−[(C1+C3)/(C1+C2+C3)](Vdata-Vref)−Vref+Vth, according to the law of conservation of charge, the potential of the gate electrode of the driving transistor DT, the potential of the first common node N1, and the potential of the second common node N2 all become Vdata+Vdd−[(C1+C3)/(C1+C2+C3)](Vdata-Vref)−Vref+Vth, that is [C2/(C1+C2+C3)](Vdata-Vref)+Vth+Vdd.

For a more intuitive description of the potentials of the first common node N1, the second common node N2, the gate electrode of the driving transistor DT, and the first electrode of the driving transistor DT in different time periods, Table 1 is referred as below.

TABLE 1

| | P1 | P2 | P3 | P4 |
|---|---|---|---|---|
| S | Vdd | Vref − Vth | [(C1 + C3)/(C1 + C2 + C3)](Vdata − Vref) + Vref − Vth | Vdd |

TABLE 1-continued

| | P1 | P2 | P3 | P4 |
|---|---|---|---|---|
| G | Vref | Vref | Vdata | [C2/(C1 + C2 + C3)](Vdata − Vref) + Vth + Vdd |
| N1 | Vref | Vref | Vdata | [C2/(C1 + C2 + C3)](Vdata − Vref) + Vth + Vdd |
| N2 | Vref | Vref | Vdata | [C2/(C1 + C2 + C3)](Vdata − Vref) + Vth + Vdd |

It should be noted that the data in Table 1 corresponds to the case where the first end of the third capacitor unit 9 is connected to both the first common node N1 and the second common node N2.

According to the specific structure of the pixel driving circuit and the working process of the pixel driving circuit in one driving cycle, in the pixel driving circuit provided by the embodiment of the present disclosure, in the reset period P1, the potential of the gate electrode of the driving transistor DT is changed to Vref, and the potential of the first electrode of the driving transistor DT is changed to Vdd, so that the voltages of the gate electrode and the first electrode of the driving transistor DT are both in a fixed bias state, the driving transistor DT is initialized. No matter each display unit displays a black picture or a white picture in a previous frame, the driving transistor DT starts the display of the next frame from a fixed bias state, which greatly improves the short-term afterimage problem caused by the hysteresis effect.

During the threshold compensation period P2, by controlling the first electrode of the driving transistor DT to be disconnected from the power supply signal input terminal ELVDD, a discharge process is implemented on the driving transistor DT until the driving transistor DT is turned off, so that the potential of the first electrode of the driving transistor DT is changed from Vdd to Vref-Vth. At the same time, the data voltage Vdata is written during the data writing-in period P3, so that the potential of the gate electrode of the driving transistor DT, the potential of the first common node N1 and the potential of the second common node N2 are all changed from Vref to Vdata. At the same time, under the coupling action of the first capacitor unit 6, the second capacitor unit 7 and the third capacitor unit 9, the potential of the first electrode of the driving transistor DT changes from Vref-Vth to [(C1+C3)/(C1+C2+C3)](Vdata-Vref)+Vref−Vth, during the light-emitting period P4, the potential of the first electrode of the driving transistor DT becomes the power supply voltage Vdd, so that the potential of the gate electrode of the driving transistor DT, the potential of the first common node N1 and the potential of the second common node N2 are all changed from Vdata to [C2/(C1+C2+C3)](Vdata-Vref)+Vth+Vdd, so that the driving transistor DT is turned on, the voltage Vgs between the gate electrode of the driving transistor DT and the first electrode of the driving transistor DT is:

$$Vgs=[C2/(C1+C2+C3)](\text{Vdata-Vref})+Vth \qquad \text{Formula (1)}$$

A driving current I generated when the driving transistor DT is turned on and operated in a saturated state is:

$$I=k(Vgs-Vth)2 \qquad \text{Formula (2)}$$

Substitute formula (1) into formula (2):

$$I=k\{[C2/(C1+C2+C3)](\text{Vdata-Vref})\}2 \qquad \text{Formula (3)}$$

In formula (3), k is a constant.

It can be seen from formula (3) that the driving current I is only related to the data voltage Vdata and the reference voltage Vref, but is not related to the threshold voltage Vth of the driving transistor DT and the power supply voltage Vdd; therefore, in the pixel driving circuit provided by the embodiment of the present disclosure, the uniformity of the driving current is improved, and the influence of the IR Drop generated on the power signal line connected to the power signal input terminal ELVDD and the threshold voltage of the driving transistor DT on the display brightness uniformity of the large-size display device is solved, the display brightness uniformity of the display device is ensured.

In addition, in the pixel driving circuit provided by the embodiment of the present disclosure, by connecting the first end of the third capacitor unit 9 to the first common node N1 and/or the second common node N2, connecting the second end of the third capacitor unit 9 to the first electrode of the driving transistor DT, so that during the light-emitting period P4, the potential of the gate electrode of the driving transistor DT is the same as the potential of the first common node N1, and/or, the potential of the gate electrode of the driving transistor DT is the same as the potential of the second common node N2, and at the same time, the potentials of the first common node N1 and the second common node N2 can be maintained through the third capacitor unit 9; therefore, the pixel driving circuit provided by the embodiment of the present disclosure effectively reduces the leakage current of the gate electrode of the driving transistor DT through the data writing sub-circuit 2 and the first reset control sub-circuit 51, even if in the case of low-frequency driving, the potential of the gate electrode of the driving transistor DT can also be well maintained, thereby greatly improving the flicker problem of the display device during display.

As shown in FIG. 1 and FIG. 2, in some embodiments, the data writing-in sub-circuit 2 includes a first double-gate transistor, and the first double-gate transistor includes a first sub-transistor T11 and a second sub-transistor T12; the gate electrode of the first sub-transistor T11 is connected to the gate electrode of the second sub-transistor T12, and is connected to the gate line GT of corresponding row, and the first electrode of the first sub-transistor T11 is connected to the data line DA of corresponding column, the second electrode of the first sub-transistor T11 is connected to the first common node N1; the first electrode of the second sub-transistor T12 is connected to the first common node N1, and the second electrode of the second sub-transistor T12 is connected to the gate electrode of the driving transistor DT.

Specifically, the specific structure of the data writing-in sub-circuit 2 is various. Exemplarily, the data writing-in sub-circuit 2 includes a first double-gate transistor, and the first double-gate transistor includes a first sub-transistor T11 and the second sub-transistor T12; the gate electrode of the first sub-transistor T11 and the gate electrode of the second sub-transistor T12 form an integral structure; the second electrode of the first sub-transistor T11 and the first electrode of the second sub-transistor T12 forms an integral structure; the first common node N1 is located between the second electrode of the first sub-transistor T11 and the first electrode of the second sub-transistor T12.

As shown in FIG. 3, FIG. 4 and FIG. 6, during the reset period P1, the threshold compensation period P2 and the light-emitting period P4, under the control of the scan signal transmitted by the gate line GT of corresponding row, the first sub-transistor T11 and the second sub-transistors T12 are all turned off.

As shown in FIG. 5, during the data writing-in period P3, under the control of the scan signal transmitted by the gate line GT of corresponding row, the first sub-transistor T11 and the second sub-transistor T12 are both turned on.

The data writing-in sub-circuit 2 includes the first double-gate transistor, so that the data writing-in sub-circuit 2 has a simple structure and occupies a smaller layout space during actual layout, which is beneficial to improve the resolution of the display device.

It is worth noting that, in addition to the above structure, the data writing-in sub-circuit 2 can also include two independent transistor structures, and the two independent transistor structures are arranged according to the connection mode of the first sub-transistor T11 and the second sub-transistor T12.

As shown in FIG. 1 and FIG. 2, in some embodiments, the first reset control sub-circuit 51 includes a second dual-gate transistor, and the second dual-gate transistor includes a third sub-transistor T22 and a fourth sub-transistor T21; the gate electrode of the third sub-transistor T22 is connected to the gate electrode of the fourth sub-transistor T21, and is connected to the reset signal line RE, and the first electrode of the third sub-transistor T22 is connected to the reference voltage input terminal Ref, the second electrode of the third sub-transistor T22 is connected to the second common node N2; the first electrode of the fourth sub-transistor T21 is connected to the second common node N2, and the second electrode of the fourth sub-transistor T21 is connected to the gate electrode of the driving transistor DT.

Specifically, the specific structure of the first reset control sub-circuit 51 is various. Exemplarily, the first reset control sub-circuit 51 includes a second double-gate transistor, and the second double-gate transistor includes a third sub-transistor T22 and the fourth sub-transistor T21; the gate electrode of the third sub-transistor T22 and the gate electrode of the fourth sub-transistor T21 form an integral structure; the second electrode of the third sub-transistor T22 and the first electrodes of the fourth sub-transistor T21 form an integral structure; the second common node N2 is located between the second electrodes of the third sub-transistors T22 and the first electrodes of the fourth sub-transistors T21.

As shown in FIG. 3 and FIG. 4, during the reset period P1 and the threshold compensation period P2, under the control of the reset signal transmitted by the reset signal line RE, the third sub-transistor T22 and the fourth sub-transistor T21 are both turned on.

As shown in FIG. 5 and FIG. 6, during the data writing-in period P3 and the light emitting period P4, under the control of the reset signal transmitted by the reset signal line RE, the third sub-transistor T22 and the fourth sub-transistor T21 are both turned off.

The first reset control sub-circuit 51 includes the second double-gate transistor, so that the first reset control sub-circuit 51 has a simple structure and occupies a smaller layout space during actual layout, which is beneficial to improve the resolution of the display device.

It should be noted that, in addition to the above-mentioned structure, the first reset control sub-circuit 51 can also include two independent transistor structures, and the two independent transistor structures are connected according to the connection mode of the third sub-transistor T22 and the fourth sub-transistor T21.

Figure 12:
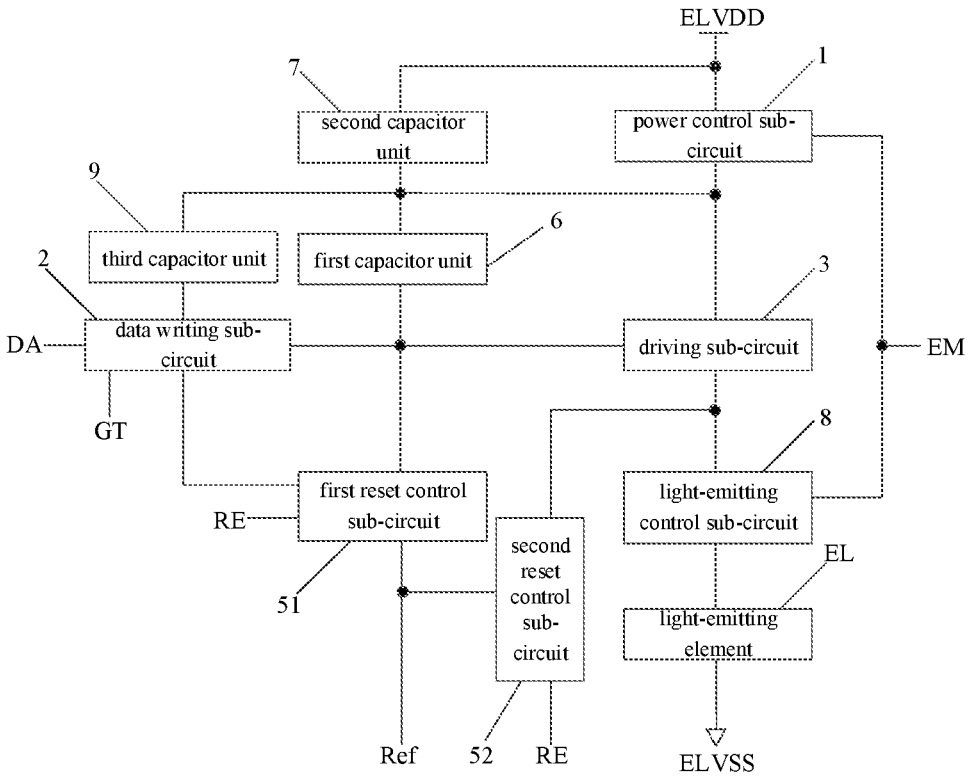
FIG. 12 is a schematic diagram of a third structure of a pixel driving circuit provided by an embodiment of the present disclosure.
Figure 13:
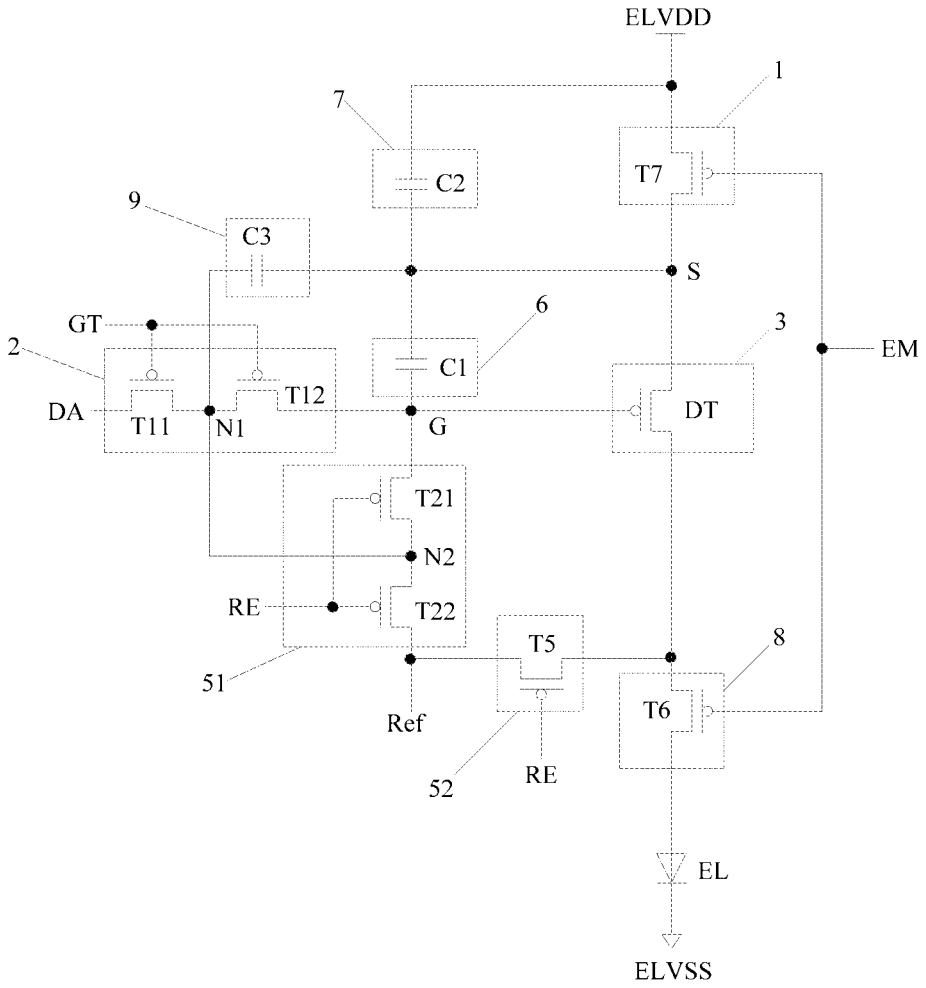
FIG. 13 is a third circuit diagram of a pixel driving circuit provided by an embodiment of the present disclosure.

As shown in FIG. 12 and FIG. 13, in some embodiments, the pixel driving circuit further includes a second reset control sub-circuit 52, and the second reset control sub-circuit 52 is respectively connected to the reset signal line RE, the second electrode of the driving transistor DT, and the reference voltage input terminal Ref; is configured to connect or disconnect the reference voltage input terminal Ref and the second electrode of the driving transistor DT under the control of the reset signal line RE.

Specifically, during the reset period P1 and the threshold compensation period P2, under the control of the reset signal transmitted by the reset signal line RE, the second reset control sub-circuit 52 controls to connect the reference voltage input terminal Ref and the second electrode of the driving transistor DT.

During the data writing-in period P3 and the light-emitting period P4, under the control of the reset signal transmitted by the reset signal line RE, the second reset control sub-circuit 52 controls to disconnect the reference voltage input terminal Ref from the second electrode of the driving transistor DT.

Since the second electrode of the driving transistor DT is connected to the anode of the light-emitting element EL, the second reset control sub-circuit 52 can reset the anode of the light-emitting element EL during the reset period P1 and the threshold compensation period P2.

As shown in FIG. 12 and FIG. 13, in some embodiments, the second reset control sub-circuit 52 includes a fifth transistor T5, the gate electrode of the fifth transistor T5 is connected to the reset signal line RE, the first electrode of the fifth transistor T5 is connected to the reference voltage input terminal Ref, and the second electrode of the fifth transistor T5 is connected to the second electrode of the driving transistor DT.

Specifically, the specific structure of the second reset control sub-circuit 52 is various. Exemplarily, the second reset control sub-circuit 52 includes the fifth transistor T5.

During the reset period P1 and the threshold compensation period P2, under the control of the reset signal transmitted by the reset signal line RE, the fifth transistor T5 is turned on, thereby controlling the connection between the reference voltage input terminal Ref and the second electrode of the driving transistor DT.

During the data writing-in period P3 and the light-emitting period P4, under the control of the reset signal transmitted by the reset signal line RE, the fifth transistor T5 is turned off, thereby controlling the disconnection of the reference voltage input terminal Ref from the second electrode of the driving transistor DT.

Figure 14:
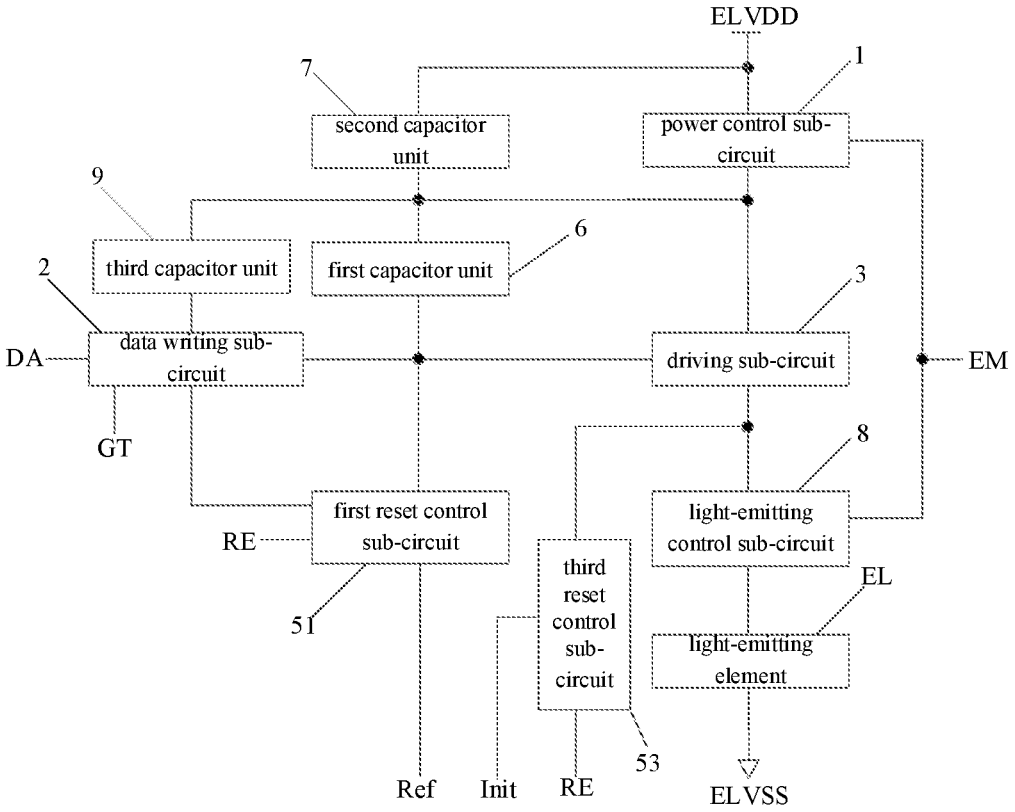
FIG. 14 is a schematic diagram of a fourth structure of a pixel driving circuit provided by an embodiment of the present disclosure.
Figure 15:
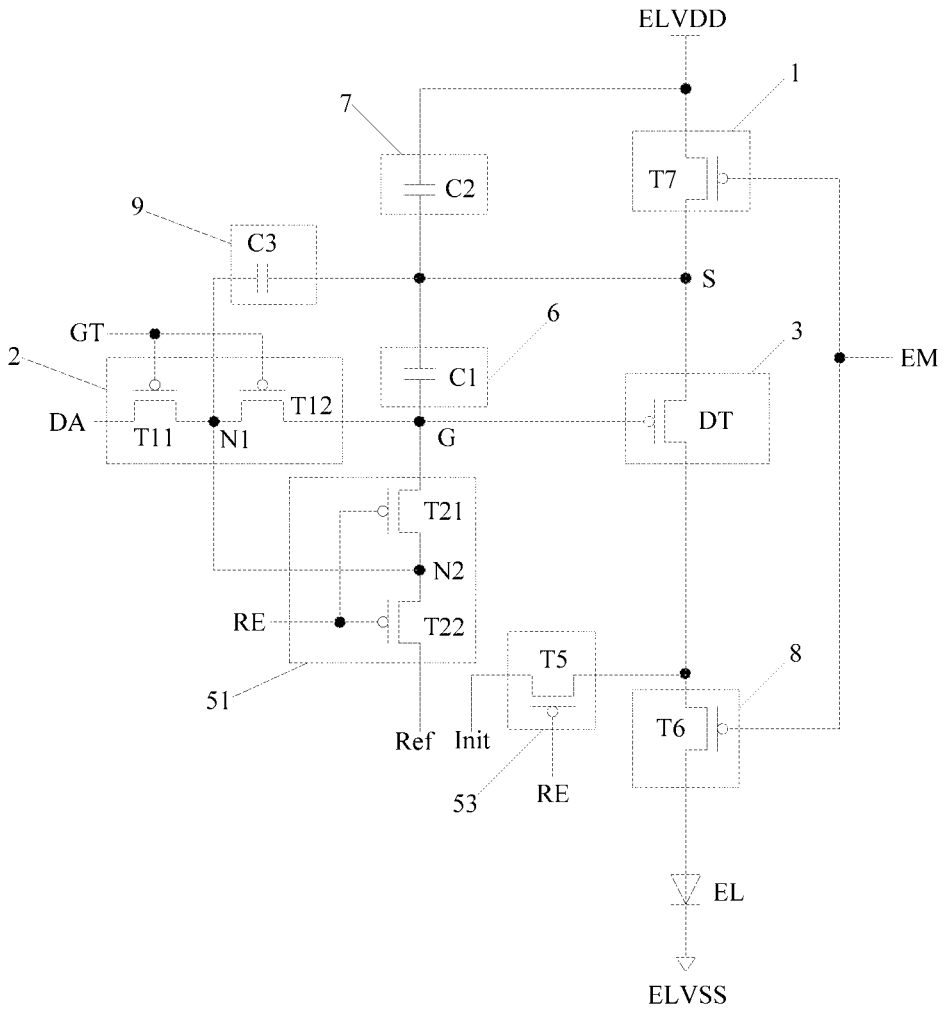
FIG. 15 is a fourth circuit diagram of a pixel driving circuit provided by an embodiment of the present disclosure.

As shown in FIG. 14 and FIG. 15, in some embodiments, the pixel driving circuit further includes a third reset control sub-circuit 53, and the third reset control sub-circuit 53 is respectively connected to the reset signal line RE, the second electrode of the driving transistor DT is connected to the initialization voltage input terminal Iint; is configured to control to connect or disconnect the initialization voltage input terminal Iint and the second electrode of the driving transistor DT under the control of the reset signal line RE.

Specifically, during the reset period P1 and the threshold compensation period P2, under the control of the reset signal transmitted by the reset signal line RE, the third reset control sub-circuit controls to connect the initialization voltage input terminal Iint and the second electrode of the drive transistor DT.

During the data writing-in period P3 and the light-emitting period P4, under the control of the reset signal transmitted by the reset signal line RE, the third reset control sub-circuit controls to disconnect the initialization voltage input terminal Iint from the second electrode of the driving transistor DT.

Since the second electrode of the driving transistor DT is connected to the anode of the light-emitting element EL, the second reset control sub-circuit 52 can reset the anode of the light-emitting element EL during the reset period P1 and the threshold compensation period P2.

The third reset control sub-circuit 53 is connected to the reset signal line RE, the second electrode of the driving transistor DT, and the initialization voltage input terminal Iint respectively, so that the initialization signal outputted by the initialization voltage input terminal Iint and the reference voltage signal outputted by the reference voltage input terminal Ref can be independently controlled, so that the potential of the reference voltage signal is not limited, and the pixel driving circuit has a wider application.

As shown in FIG. 14 and FIG. 15, in some embodiments, the third reset control sub-circuit 53 includes a fifth transistor T5, the gate electrode of the fifth transistor T5 is connected to the reset signal line RE, the first electrode of the fifth transistor T5 is connected to the initialization voltage input terminal Iint, and the second electrode of the fifth transistor T5 is connected to the second electrode of the driving transistor DT.

Specifically, during the reset period P1 and the threshold compensation period P2, under the control of the reset signal transmitted by the reset signal line RE, the fifth transistor T5 is turned on, so that the initialization voltage input terminal Iint and the second electrode of the driving transistor DT are controlled to be connected.

During the data writing-in period P3 and the light-emitting period P4, under the control of the reset signal transmitted by the reset signal line RE, the fifth transistor T5 is turned off, and the initialization voltage input terminal Iint is controlled to be disconnected from the second electrode of the driving transistor DT.

Figure 10:
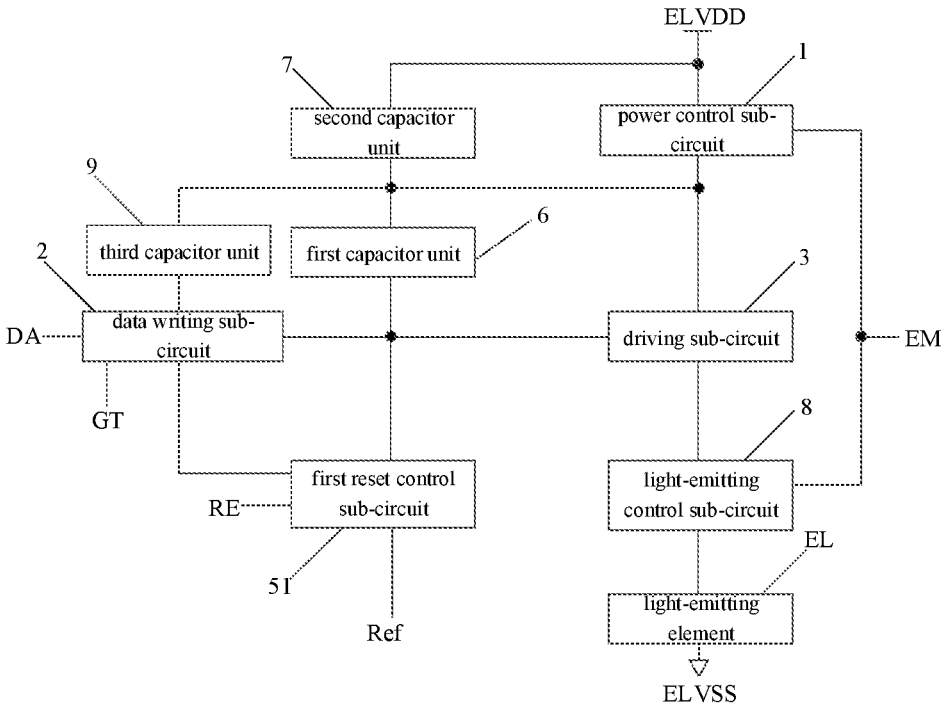
FIG. 10 is a schematic diagram of a second structure of a pixel driving circuit provided by an embodiment of the present disclosure.
Figure 11:
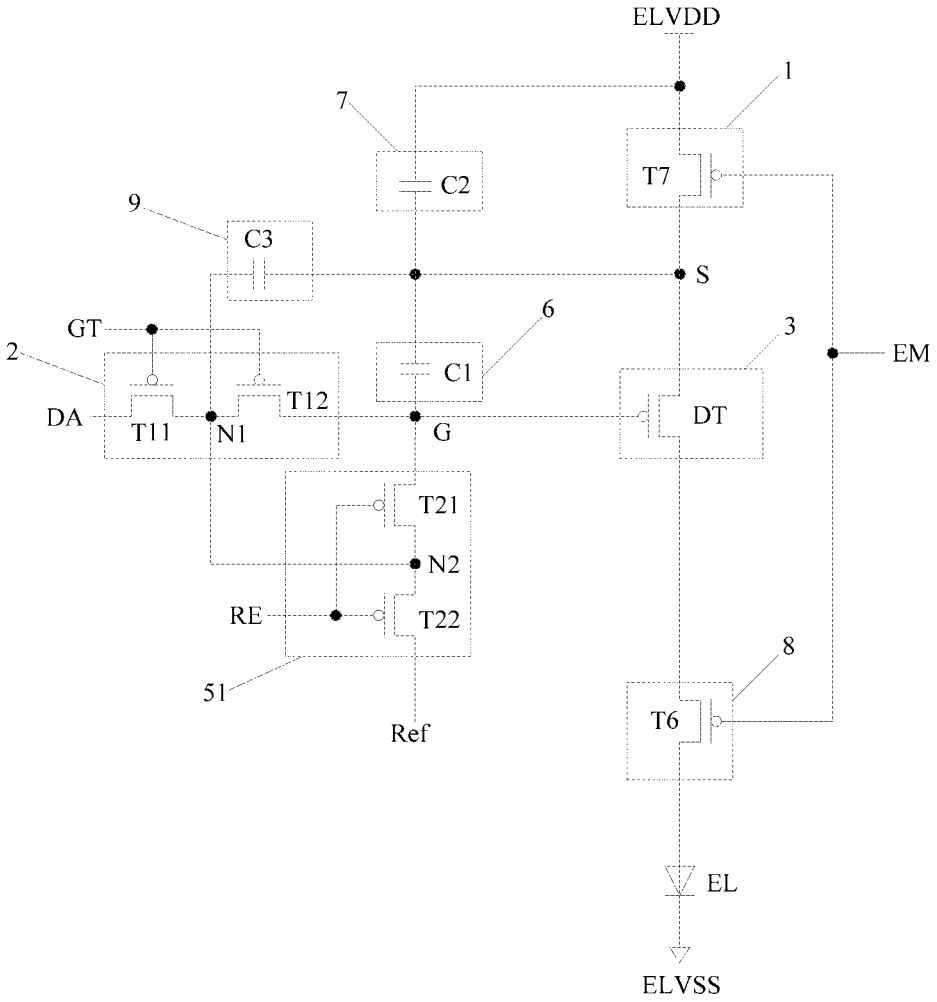
FIG. 11 is a second circuit diagram of a pixel driving circuit provided by an embodiment of the present disclosure.

As shown in FIG. 10 and FIG. 11, in some embodiments, the pixel driving circuit further includes a light-emitting control sub-circuit 8, and the second electrode of the driving transistor DT is connected to the light-emitting element EL through the light-emitting control sub-circuit 8; the light-emitting control sub-circuit 8 is respectively connected to the first control terminal EM, the second electrode of the driving transistor DT and the light-emitting element EL, and is configured to connect or disconnect the second electrode of the driving transistor DT and the light emitting element EL under the control of the first control terminal EM.

Figure 7:
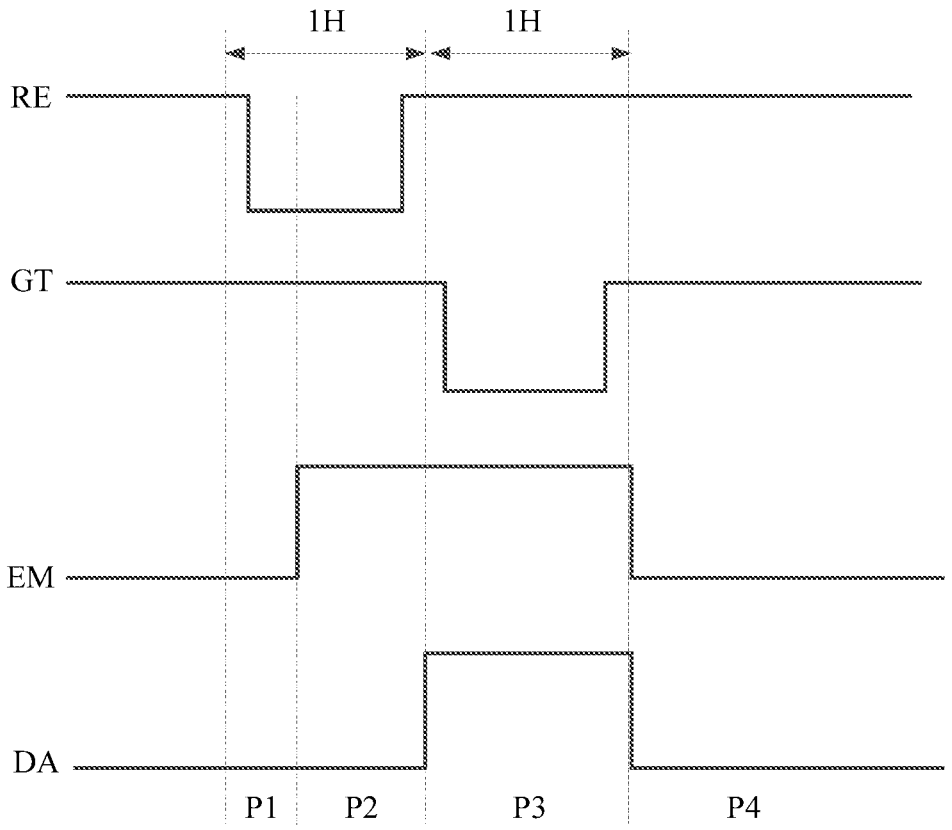
FIG. 7 is a first timing sequence diagram of the pixel driving circuit provided by the embodiment of the present disclosure.

Specifically, as shown in FIG. 7, during the reset period P1 and the light-emitting period P4, under the control of the first control terminal EM, the light-emitting control sub-circuit 8 controls to connect the second electrode of the driving transistor DT and the anode of the light-emitting element EL.

During the threshold compensation period P2 and the data writing-in period P3, under the control of the first control terminal EM, the light-emitting control sub-circuit 8 controls to disconnect the second electrode of the driving transistor DT from the anode of the light-emitting element EL, so that abnormal light emitting of the light emitting element EL during the threshold value compensation period P2 and the data writing-in period P3 is avoided.

As shown in FIG. 10 and FIG. 11, in some embodiments, the light-emitting control sub-circuit 8 includes a sixth transistor T6, the gate electrode of the sixth transistor T6 is connected to the first control terminal EM, and the first electrode of the sixth transistor T6 is connected to the second electrode of the driving transistor DT, and the second electrode of the sixth transistor T6 is connected to the light emitting element EL.

Specifically, the specific structure of the light-emitting control sub-circuit 8 is various. Exemplarily, the light-emitting control sub-circuit 8 includes the sixth transistor T6.

During the reset period P1 and the light-emitting period P4, under the control of the first control terminal EM, the sixth transistor T6 is turned on to control to connect the second electrode of the driving transistor DT and the anode of the light-emitting element EL.

During the threshold compensation period P2 and the data writing-in period P3, under the control of the first control terminal EM, the sixth transistor T6 is turned off, and controls to disconnect the second electrode of the driving transistor DT from the anode of the light-emitting element EL, so that abnormal light emitting of the light-emitting element EL during the threshold compensation period P2 and the data writing-in period P3 is avoided.

As shown in FIG. 1 and FIG. 2, in some embodiments, the power control sub-circuit 1 includes a seventh transistor T7, the gate electrode of the seventh transistor T7 is connected to the first control terminal EM, and the first electrode of the seventh transistor T7 is connected to the power signal line input terminal, and the second electrode of the seventh transistor T7 is connected to the first electrode of the driving transistor DT.

Specifically, the specific structure of the power supply control sub-circuit 1 is various. Exemplarily, the power supply control sub-circuit 1 includes the seventh transistor T7.

During the reset period P1 and the light-emitting period P4, under the control of the first control terminal EM, the seventh transistor T7 is turned on, and controls to connect the power signal line input terminal and the first electrode of the driving transistor DT.

During the threshold compensation period P2 and the data writing-in period P3, under the control of the first control terminal EM, the seventh transistor T7 is turned off, and controls to disconnect the power signal line input terminal from the first electrode of the driving transistor DT.

Embodiments of the present disclosure further provide a display device, including the pixel driving circuit provided by the above embodiments.

In the pixel driving circuit provided by the above embodiment, during the reset period P1, the potential of the gate electrode of the driving transistor DT is changed to Vref, and the potential of the first electrode of the driving transistor DT is changed to Vdd, so that the gate electrode of the driving transistor DT and the first electrode of the driving transistor DT are both in a fixed bias state, so that the driving transistor DT is initialized. Therefore, no matter whether each pixel unit displays a black picture or a white picture in the previous frame, the driving transistor DT starts to display the next frame from the fixed bias state, which greatly improves the short-term afterimage problem caused by the hysteresis effect.

In the pixel driving circuit provided by the embodiment of the present disclosure, the uniformity of the driving current is improved, and the influence of the IR Drop generated on the power signal line connected to the power signal input terminal ELVDD and the threshold voltage of the driving transistor DT on the display brightness uniformity of the large-size display device is solved, the display brightness uniformity of the display device is ensured.

The pixel driving circuit provided by the above embodiment effectively reduces the current leakage of the gate electrode of the driving transistor DT through the data writing-in sub-circuit 2 and the first reset control sub-circuit 51, even in the case of low-frequency driving, the potential of the gate electrode of the driving transistor DT can also be maintained, so that the flicker problem of the display device during display is improved.

Therefore, the display device provided by the embodiment of the present disclosure also has the above beneficial effects when including the pixel driving circuit provided by the above embodiment, and which is not repeated.

It should be noted that the display device may be any product or component with a display function, such as a TV, a monitor, a digital photo frame, a mobile phone, and a tablet computer.

In some embodiments, the display device further includes a gate driving circuit, a reset signal control circuit, a plurality of gate lines GT and a plurality of reset signal lines RE;

The gate driving circuit includes a plurality of first shift register units corresponding to the plurality of gate lines GT in a one-to-one manner, and each first shift register unit is connected to a corresponding gate line GT, and is configured to provide a scan signal for the corresponding gate line GT.

The reset signal control circuit includes a plurality of second shift register units corresponding to the plurality of reset signal lines RE in a one-to-one manner, and each second shift register unit is connected to the corresponding reset signal line RE, and is configured to provide a reset signal to the reset signal line RE.

Specifically, the display device includes a plurality of gate lines GT and a plurality of data lines DA, and the gate lines GT and the data lines DA are crossing to each other. The display device further includes a plurality of reset signal lines RE and a plurality of first control signal lines, and the extension direction of the reset signal lines RE and the first control signal lines are substantially the same as the extension direction of the gate lines GT. Exemplarily, the gate lines GT, the reset signal lines RE and the first control signal lines all extend along a first direction, and the data lines DA extends along a second direction.

The display device includes a plurality of pixel driving circuits arranged in an array, and the plurality of pixel driving circuits can be divided into a plurality of rows of pixel driving circuits and a plurality of columns of pixel driving circuits. The plurality of rows of pixel driving circuits are arranged in sequence along the second direction, and each row of pixel driving circuits includes a plurality of pixel driving circuits arranged in sequence along the first direction. The plurality of columns of pixel driving circuits are arranged in sequence along the first direction, and each column of pixel driving circuits includes a plurality of pixel driving circuits arranged in sequence along the second direction.

The plurality of rows of pixel driving circuits correspond to the plurality of gate lines GT in a one-to-one manner, and the gate lines GT are respectively connected to data writing-in sub-circuits 2 included in pixel driving circuits in a row of pixel driving circuits.

The plurality of rows of pixel driving circuits correspond to the plurality of reset signal lines RE in a one-to-one manner, and the reset signal line RE is connected to the first reset control sub-circuit 51 included in each pixel driving circuit in a corresponding row of pixel driving circuits.

The plurality of rows of pixel driving circuits correspond to the plurality of first control signal lines in a one-to-one manner, and the first control signal line is connected to the first control terminals EM connected to each pixel driving circuit in a corresponding row of pixel driving circuits.

The display device further includes a gate driving circuit and a reset signal control circuit arranged in a peripheral area of the display device, and the gate driving circuit includes a plurality of first shift register units corresponding to the plurality of gate lines GT in a one-to-one manner, the first shift register unit is connected to the corresponding gate line GT, and is used to provide a scanning signal for the corresponding gate line GT; the reset signal control circuit includes a plurality of second shift register units corresponding to the plurality of reset signal lines RE in a one-to-one manenr, the second shift register unit is connected to the corresponding reset signal line RE, and is used for providing a reset signal to the corresponding reset signal line RE.

Figure 9:
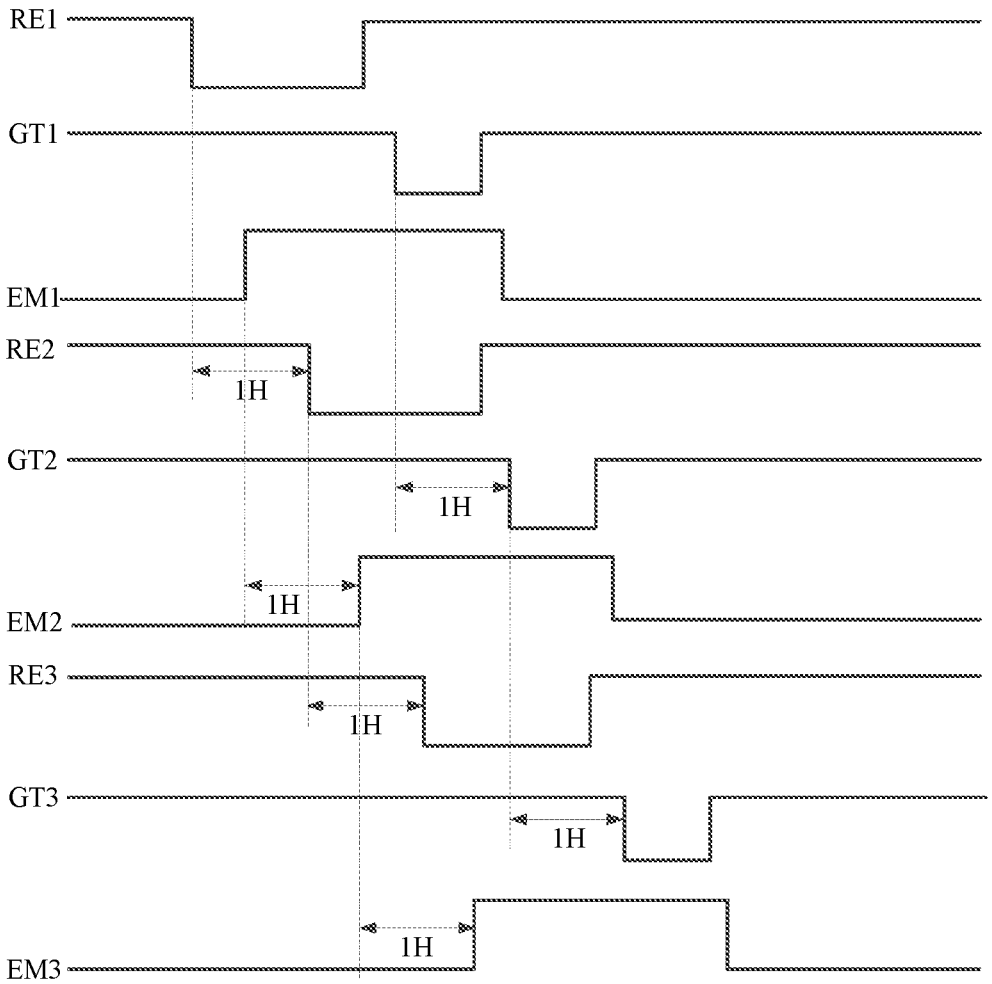
FIG. 9 is a third timing sequence diagram of the pixel driving circuit provided by the embodiment of the present disclosure.

As shown in FIG. 9, the timing sequence of the reset signal transmitted on the reset signal line RE1 corresponding to the first row of pixel driving circuits; the timing sequence of the reset signal transmitted on the reset signal line RE2 corresponding to the second row of pixel driving circuits; the timing sequence of the reset signal transmitted on the reset signal line RE3 corresponding to the third row of pixel driving circuits; the timing sequence of the scan signal transmitted on the gate line GT1 corresponding to the first row of pixel driving circuits; the timing sequence of the scan signal transmitted on the gate line GT2 corresponding to the second row of pixel driving circuits; the timing sequence of the scan signal transmitted on the gate line GT3 corresponding to the third row of pixel driving circuits; the timing sequence of the first control signal transmitted on the first control signal line EM1 corresponding to the first row of pixel driving circuits; the timing sequence of the first control signal transmitted on the first control signal line EM2 corresponding to the second row of pixel driving circuits; the timing sequence of the first control signal transmitted on the first control signal line EM3 corresponding to the third row of pixel driving circuits.

Figure 8:
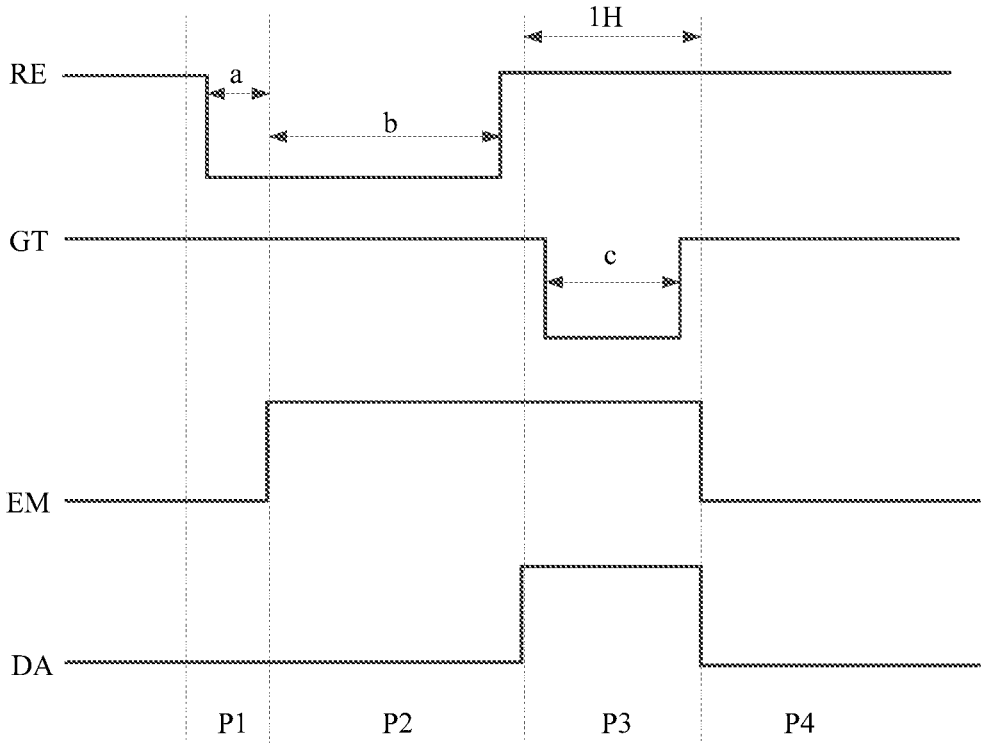
FIG. 8 is a second timing sequence diagram of the pixel driving circuit provided by the embodiment of the present disclosure.

It should be noted that 1H marked in FIG. 7, FIG. 8 and FIG. 9 represents one row period.

In the display device provided by the above embodiment, the threshold compensation and data writing-in are two independent processes, that is, the threshold compensation process is performed in the threshold compensation period P2, and the data writing-in process is performed in the data writing-in period P3. The display device include the gate driving circuit and the reset signal control circuit, so that the signal transmitted on the gate line GT and the signal transmitted on the reset signal line RE are independently controlled, when the display device is refreshed at a high frame rate, although the data voltage writing time will be reduced, the reset signal control circuit controls the effective level time of the signal transmitted on the reset signal line RE to be extended, so as to ensure that the pixel driving circuit has a longer compensation in one working cycle time and ensure the compensation effect on the pixel drive circuit.

An embodiment of the present disclosure further provides a method for driving a pixel driving circuit, which is applied to the pixel driving circuit provided in the above-mentioned embodiments, and the method includes: in each working cycle, During a reset period P1, the power supply signal input terminal ELVDD inputs the power supply voltage Vdd, and under the control of the first control terminal EM, the power supply control sub-circuit 1 controls to connect the power supply signal input terminal ELVDD and the first electrode of the driving transistor DT. The reference voltage input terminal Ref inputs the reference voltage Vref, and under the control of the corresponding reset signal line RE, the first reset control sub-circuit 51 controls to connect the reference voltage input terminal Ref and the second common node N2, and controls to connect the second common node N2 and the gate electrode of the driving transistor DT, so that the driving transistor DT is in an on state;

During the threshold compensation period P2, under the control of the first control terminal EM, the power control sub-circuit 1 controls to disconnect the power signal input terminal ELVDD from the first electrode of the driving transistor DT, so that the driving transistor DT is changed from an on state to an off state, the potential of the first electrode of the driving transistor DT changes from Vdd to Vref-Vth, where Vth is the threshold voltage of the driving transistor DT;

During the data writing-in period P3, under the control of the reset signal line RE, the first reset control sub-circuit 51 controls to disconnect the reference voltage input terminal Ref from the second common node N2, and control to disconnect the second common node N2 from the gate electrode of the driving transistor DT; the data line DA of corresponding column inputs the data voltage Vdata, and under the control of the gate line GT of corresponding row, the data writing-in sub-circuit 2 controls to connect the data line DA and the first common node N1, and control to connect the first common node N1 and the gate electrode of the driving transistor DT, so that the potential of the gate electrode of the driving transistor DT, the potential of the first common node N1 and the potential of the second common node N2 are all changed from Vref to Vdata, and the potential of the first electrode of the driving transistor DT is changed under the coupling action of a first capacitor unit 6, a second capacitor unit 7 and a third capacitor unit 9;

During the light-emitting period P4, the power signal input terminal ELVDD inputs the power supply voltage Vdd, and under the control of the first control terminal EM, the power control sub-circuit 1 controls to connect the power signal input terminal ELVDD and the first electrode of the driving transistors DT, under the control of the gate line GT of corresponding row, the data writing-in sub-circuit 2 controls to disconnect the data line DA from the first common node N1, and control to disconnect the first common node N1 from the gate electrode of the driving transistor DT, the potential of the gate electrode of the driving transistor DT, the potential of the first common node N1 and the potential of the second common node N2 are changed under the coupling control of the first capacitor unit 6, the second capacitor unit 7 and the third capacitor unit 9, so that the driving transistor DT is turned on to drive light-emitting element EL to emit light.

When the above-mentioned pixel driving circuit is driven by the method provided by the embodiment of the present disclosure, during the reset period P1, the potential of the gate electrode of the driving transistor DT is changed to Vref, and the potential of the first electrode of the driving transistor DT is changed to Vdd, so that the gate electrode and the first electrode of the driving transistor DT becomes are both in a fixed bias state, thereby initializing the driving transistor DT. Therefore, no matter each pixel unit displays a black picture or a white picture in the previous frame, the driving transistor DT starts the display of the next frame from the fixed bias state, which greatly improves the short-term afterimage problem caused by the hysteresis effect.

During the threshold compensation period P2, by controlling the first electrode of the driving transistor DT to be disconnected from the power supply signal input terminal ELVDD, a discharge process is implemented on the driving transistor DT until the driving transistor DT is turned off, so that the potential of the first electrode of the driving transistor DT is Changed from Vdd to Vref-Vth. At the same time, the data voltage Vdata is written during the data writing-in period P3, so that the potential of the gate electrode of the driving transistor DT, the potential of the first common node N1 and the potential of the second common node N2 are all changed from Vref to Vdata. At the same time, under the coupling action of the first capacitor unit 6, the second capacitor unit 7 and the third capacitor unit 9, the potential of the first electrode of the driving transistor DT changes from Vref-Vth to [(C1+C3)/(C1+C2+C3)](Vdata-Vref)+Vref−Vth, during the light-emitting period P4, the potential of the first electrode of the driving transistor DT becomes the power supply voltage Vdd, so that the potential of the gate electrode of the driving transistor DT, the potential of the first common node N1 and the potential of the second common node N2 are changed from Vdata to [C2/(C1+C2+C3)](Vdata-Vref)+Vth+Vdd, the driving transistor DT is turned on, the voltage Vgs between the gate electrode of the driving transistor DT and the first electrode of the driving transistor DT is:

$$Vgs=[C2/(C1+C2+C3)](\text{Vdata-Vref})+Vth \qquad \text{Formula(1)}$$

The driving current I generated when the driving transistor DT is turned on and operated in a saturated state is:

$$I=k(Vgs-Vth)^2 \qquad \text{Formula (2)}$$

Substituting Formula (1) into Formula (2):

$$I=k\{[C2/(C1+C2+C3)](\text{Vdata-Vref})\}^2 \qquad \text{Formula (3)}$$

In Formula (3), k is a constant.

It can be seen from Formula (3) that the driving current I is only related to the data voltage Vdata and the reference voltage Vref, but is not related to the threshold voltage Vth of the driving transistor DT and the power supply voltage Vdd; therefore, the driving method provided by the embodiment of the present disclosure is used to drive the pixel driving circuit, the uniformity of the driving current is improved, and the influence of the IR Drop generated on the power signal line connected to the power signal input terminal ELVDD and the threshold voltage of the driving transistor DT on the display brightness uniformity of the large-size display device is solved, the display brightness uniformity of the display device is ensured.

In addition, when using the method provided by the embodiment of the present disclosure to drive the above-mentioned pixel driving circuit, the first end of the third capacitor unit 9 is connected to the first common node N1 and/or the second common node N2, the second end of the third capacitor unit 9 is connected to the first electrode of the driving transistor DT, so that during the light-emitting period P4, the potential of the gate electrode of the driving transistor DT is the same as the potential of the first common node N1 and/or, the potential of the gate electrode of the driving transistor DT is the same as the potential of the second common node N2, the potentials of the first common node N1 and the second common node N2 can both be maintained through the third capacitor unit 9. Therefore, when the method provided by the embodiment of the present disclosure is used to drive the above-mentioned pixel driving circuit, the leakage current of the gate electrode of the driving transistor DT flowing through the data writing-in sub-circuit 2 and the first reset control sub-circuit 51 is effectively reduced, even in the case of low-frequency driving, the potential of the gate electrode of the driving transistor DT may be maintained, thereby greatly improving the flickering of the display device during display.

As shown in FIG. 2 and FIG. 8, in some embodiments, the display device to which the pixel driving circuit is applied further includes a gate driving circuit, a reset signal control circuit, a plurality of gate lines GT and a plurality of reset signal lines RE; the gate driving circuit includes a plurality of first shift register units corresponding to the plurality of gate lines GT in a one-to-one manner, and each first shift register unit is connected to the corresponding gate line GT, and is used to provide a scan signal for the corresponding gate line GT; the reset signal control circuit includes a plurality of second shift register units corresponding to the plurality of reset signal lines RE in a one-to-one manner, and each second shift register unit is connected to the corresponding reset signal line RE, and is used to provide a reset signal for the corresponding reset signal line RE;

During the threshold compensation period P2, the first reset control sub-circuit 51 controls to connect the reference voltage input terminal Ref and the second common node N2, and controls to connect the second common node N2 and the gate electrode of the driving transistors DT for a first time length b; during the data writing-in period P3, the data writing-in sub-circuit 2 controls to connect the data line DA and the first common node N1 and controls to connect the first common node N1 and the gate electrode of the driving transistor DT for a second time length c; the first time length b is greater than the second time length c.

Specifically, FIG. 8 shows a schematic diagram of the working timing sequence of the pixel driving circuit when the display device is refreshed at a high frame rate. During the reset period P1, under the control of the corresponding reset signal line RE, the first reset control sub-circuit 51 controls to connect the reference voltage input terminal Ref and the second common node N2, and controls to connect the second common node N2 and the gate electrode of the driving transistor DT for a third time length a.

During the threshold compensation period P2, under the control of the corresponding reset signal line RE, the first reset control sub-circuit 51 controls to connect the reference voltage input terminal Ref and the second common node N2, and controls to connect the second common node N2 and the gate electrode of the driving transistor DT for a first time length b.

During the data writing-in period P3, under the control of the gate line GT of corresponding row, the data writing sub-circuit 2 controls to connect the data line DA and the first common node N1, and controls to connect the first common node N1 and the gate electrode of the driving transistor DT for a second time length c.

Since the display device includes the gate driving circuit and the reset signal control circuit, the signal transmitted on the gate line GT and the signal transmitted on the reset signal line RE can be independently controlled, so that the display device has a high refresh frame rate, although the data voltage writing-in time (i.e. the second time length c) will be shortened, the reset signal control circuit may control the effective level time (i.e. the first time) of the signal transmitted on the reset signal line RE to be extended, so that the first time length b is greater than the second time length c, thereby ensuring that the pixel driving circuit has a longer compensation time in one working cycle and ensuring the compensation effect on the pixel driving circuit.

In some embodiments, the pixel driving circuit may further include a light-emitting control sub-circuit 8, and the second electrode of the driving transistor DT is connected to the light-emitting element EL through the light-emitting control sub-circuit 8; the light-emitting control sub-circuit 8 is respectively connected to the first control terminal EM, the second electrode of the driving transistor DT and the light-emitting element EL; the driving method further includes:

During the threshold compensation period P2 and the data writing-in period P3, under the control of the first control terminal EM, the light-emitting control sub-circuit 8 controls to disconnect the second electrode of the driving transistor DT from the light-emitting elements EL, so that the light-emitting elements EL do not emit light during the threshold compensation period P2 and the data writing-in period P3.

Specifically, as shown in FIG. 7, during the reset period P1 and the light-emitting period P4, under the control of the first control terminal EM, the light-emitting control sub-circuit 8 controls to connect the second electrode of the driving transistor DT and the anode of the light-emitting element EL.

During the threshold compensation period P2 and the data writing-in period P3, under the control of the first control terminal EM, the light-emitting control sub-circuit 8 controls to disconnect the second electrode of the driving transistor DT from the anode of the light-emitting element EL, so as to avoid abnormal light emission of the light emitting element EL druing the threshold value compensation period P2 and the data writing-in period P3.

It should be noted that the various embodiments in this specification are described in a progressive manner, and the same or similar parts among the various embodiments can be referred to each other, and each embodiment focuses on the differences from other embodiments. In particular, for the method embodiment, since it is basically similar to the product embodiment, the description is relatively simple, and the relevant part can be referred to the description of the product embodiment.

Unless otherwise defined, the technical or scientific terms used in the present disclosure shall have the usual meanings understood by those with ordinary skills in the field to which this disclosure belongs. The "first", "second" and similar words used in the present disclosure do not indicate any order, quantity or importance, but are only used to distinguish different components. The word "include" or "comprise" and other similar words mean that the element or item appearing before the word encompasses the element or item listed after the word and its equivalents, but does not exclude other elements or items. Similar words such as "connected" or "coupled" are not limited to physical or mechanical connections, but may include electrical connections, whether direct or indirect. "Up", "Down", "Left", "Right", etc. are only used to indicate the relative position relationship. When the absolute position of the described object changes, the relative position relationship may also change accordingly.

It can be understood that when an element such as a layer, film, area, or substrate is referred to as being "on" or "under" another element, the element can be "directly" on or "under" the other element, or there may be intermediate elements therebetween.

In the description of the foregoing embodiments, specific features, structures, materials, or characteristics may be combined in any one or more embodiments or examples in an appropriate manner.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A pixel driving circuit for driving a light-emitting element, comprising:

a driving transistor, wherein a second electrode of the driving transistor is connected to the light-emitting element;

a power control sub-circuit, respectively connected to a first control terminal, a power signal input terminal and a first electrode of the driving transistor;

a data writing-in sub-circuit, respectively connected to a first common node, a gate line of a corresponding row, a data line of a corresponding column and a gate electrode of the driving transistor, and configured to, under the control of the gate line, control to connect or disconnect the data line and the first common node, and control to connect or disconnect the first common node and the gate electrode of the driving transistor;

a first reset control sub-circuit, respectively connected to a second common node, a reset signal line, the gate electrode of the driving transistor and a reference voltage input terminal; configured to, under the control of the reset signal line, control to connect or disconnect the reference voltage input terminal and the second common node, and control to connect or disconnect the second common node and the gate electrode of the driving transistor;

a first capacitor unit, wherein a first end of the first capacitor unit is connected to the gate electrode of the drive transistor, and a second end of the first capacitor unit is connected to the first electrode of the drive transistor;

a second capacitor unit, wherein a first end of the second capacitor unit is connected to the first electrode of the driving transistor, and a second end of the second capacitor unit is connected to the power signal input terminal; and a third capacitor unit, a first end of the third capacitor unit is connected to the first common node and/or the second common node, and a second end of the third capacitor unit is connected to the first electrode of the driving transistor.

2. The pixel driving circuit according to claim 1, wherein the data writing-in sub-circuit includes a first double-gate transistor, and the first double-gate transistor includes a first sub-transistor and a second sub-transistor;

a gate electrode of the first sub-transistor is connected to a gate electrode of the second sub-transistor, and is connected to the gate line of the corresponding row, and a first electrode of the first sub-transistor is connected to the data line of the corresponding column, a second electrode of the first sub-transistor is connected to the first common node;

a first electrode of the second sub-transistor is connected to the first common node, and a second electrode of the second sub-transistor is connected to the gate electrode of the driving transistor.

3. The pixel driving circuit according to claim 1, wherein the first reset control sub-circuit comprises a second dual-gate transistor, and the second dual-gate transistor comprises a third sub-transistor and a fourth sub-transistor;

a gate electrode of the third sub-transistor is connected to a gate electrode of the fourth sub-transistor and is connected to the reset signal line, and a first electrode of the third sub-transistor is connected to the reference voltage input terminal, a second electrode of the third sub-transistor is connected to the second common node;

a first electrode of the fourth sub-transistor is connected to the second common node, and a second electrode of the fourth sub-transistor is connected to the gate electrode of the driving transistor.

4. The pixel driving circuit according to claim 1, wherein the pixel driving circuit further comprises:

a second reset control sub-circuit, respectively connected to the reset signal line, the second electrode of the driving transistor and the reference voltage input terminal; configured to, under the control of the reset signal line, control to connect or disconnect the reference voltage input terminal and the second electrode of the driving transistor.

5. The pixel driving circuit according to claim 4, wherein the second reset control sub-circuit includes a fifth transistor, a gate electrode of the fifth transistor is connected to the reset signal line, a first electrode of the fifth transistor is connected to the reference voltage input terminal, and a second electrode of the fifth transistor is connected to the second electrode of the driving transistor.

6. The pixel driving circuit according to claim 1, wherein the pixel driving circuit further comprises:

a third reset control sub-circuit, respectively connected to the reset signal line, the second electrode of the driving transistor and the initialization voltage input terminal; configured to, under the control of the reset signal line, control to connect or disconnect the initialization voltage input terminal and the second electrode of the driving transistor.

7. The pixel driving circuit according to claim 6, wherein the third reset control sub-circuit includes a fifth transistor, a gate electrode of the fifth transistor is connected to the reset signal line, a first electrode of the fifth transistor is connected to the initialization voltage input terminal, and a second electrode of the fifth transistor is connected to the second electrode of the driving transistor.

8. The pixel driving circuit according to claim 1, wherein the pixel driving circuit further includes a light-emitting control sub-circuit, and the second electrode of the driving transistor is connected to the light-emitting element through the light-emitting control sub-circuit;

the light-emitting control sub-circuit is respectively connected to the first control terminal, the second electrode of the driving transistor and the light-emitting element, and is configured to connect or disconnect the second electrode of the driving transistor and the light emitting element under the control of the first control terminal.

9. The pixel driving circuit according to claim 8, wherein the light-emitting control sub-circuit includes a sixth transistor, a gate electrode of the sixth transistor is connected to the first control terminal, and a first electrode of the sixth transistor is connected to the second electrode of the driving transistor, and a second electrode of the sixth transistor is connected to the light emitting element.

10. The pixel driving circuit according to claim 1, wherein the power control sub-circuit includes a seventh transistor, a gate electrode of the seventh transistor is connected to the first control terminal, and a first electrode of the seventh transistor is connected to the power signal line input terminal, and a second electrode of the seventh transistor is connected to the first electrode of the driving transistor.

11. A display device comprising the pixel driving circuit according to claim 1.

12. The display device according to claim 11, wherein the display device further comprises a gate driving circuit, a reset signal control circuit, a plurality of gate lines and a plurality of reset signal lines;

the gate driving circuit includes a plurality of first shift register units corresponding to the plurality of gate lines in a one-to-one manner, and each of the plurality of first shift register units is connected to a corresponding gate line, and is configured to provide a scan signal for the corresponding gate line;

the reset signal control circuit includes a plurality of second shift register units corresponding to the plurality of reset signal lines in a one-to-one manner, and each of the plurality of second shift register units is connected to a corresponding reset signal line, and is configured to provide a reset signal to the corresponding reset signal line.

13. A method of driving a pixel driving circuit according to claim 1, wherein the method comprises: in each working cycle, during a reset period, the power supply signal input terminal inputs a power supply voltage Vdd, and under the control of the first control terminal, the power supply control sub-circuit controls to connect the power supply signal input terminal and the first electrode of the driving transistor, the reference voltage input terminal inputs a reference voltage Vref, and under the control of the corresponding reset signal line, the first reset control sub-circuit controls to connect the reference voltage input terminal and the second common node, and controls to connect the second common node and the gate electrode of the driving transistor, so that the driving transistor is in an on state;

during a threshold compensation period, under the control of the first control terminal, the power control sub-circuit controls to disconnect the power signal input terminal from the first electrode of the driving transistor, so that the driving transistor is changed from the on state to an off state, a potential of the first electrode of the driving transistor changes from Vdd to Vref-Vth, wherein Vth is a threshold voltage of the driving transistor;

during a data writing-in period, under the control of the reset signal line, the first reset control sub-circuit controls to disconnect the reference voltage input terminal from the second common node, and control to disconnect the second common node from the gate electrode of the driving transistor; the data line of corresponding column inputs the data voltage Vdata, and under the control of the gate line of the corresponding row, the data writing-in sub-circuit controls to connect the data line of the corresponding column and the first common node, and control to connect the first common node and the gate electrode of the driving transistor, so that a potential of the gate electrode of the driving transistor, a potential of the first common node and a potential of the second common node are all changed from Vref to Vdata, and a potential of the first electrode of the driving transistor is changed under a coupling action of a first capacitor unit, a second capacitor unit and a third capacitor unit;

during a light-emitting period, the power signal input terminal inputs the power supply voltage Vdd, and under the control of the first control terminal, the power control sub-circuit controls to connect the power signal input terminal and the first electrode of the driving transistors, under the control of the gate line of corresponding row, the data writing-in sub-circuit controls to disconnect the data line of the corresponding column from the first common node, and control to disconnect the first common node from the gate electrode of the driving transistor, the potential of the gate electrode of the driving transistor, the potential of the first common node and the potential of the second common node are changed under the coupling control of the first capacitor unit, the second capacitor unit and the third capacitor unit, so that the driving transistor is turned on to drive light-emitting element to emit light.

14. The method according to claim 13, wherein the display device to which the pixel driving circuit is applied further comprises a gate driving circuit, a reset signal control circuit, a plurality of gate lines and a plurality of reset signal lines; the gate driving circuit includes a plurality of first shift register units corresponding to the plurality of gate lines in a one-to-one manner, and each of the plurality of first shift register units is connected to a corresponding gate line, and is configured to provide a scan signal for the corresponding gate line; the reset signal control circuit includes a plurality of second shift register units corresponding to the plurality of reset signal lines in a one-to-one manner, and each of the plurality of second shift register units is connected to a corresponding reset signal line, and is configured to provide a reset signal for the corresponding reset signal line;

during the threshold compensation period, the first reset control sub-circuit controls to connect the reference voltage input terminal and the second common node, and controls to connect the second common node and the gate electrode of the driving transistors for a first time length;

during the data writing-in period, the data writing-in sub-circuit controls to connect the data line of the corresponding column and the first common node, and controls to connect the first common node and the gate electrode of the driving transistor for a second time length;

the first time length is greater than the second time length.

15. The method according to claim 13, wherein the pixel driving circuit further includes a light-emitting control sub-circuit, and the second electrode of the driving transistor is connected to the light-emitting element through the light-emitting control sub-circuit; the light-emitting control sub-circuit is respectively connected to the first control terminal, the second electrode of the driving transistor and the light-emitting element; the method further includes:

during the threshold compensation period and the data writing-in period, under the control of the first control terminal, the light-emitting control sub-circuit controls to disconnect the second electrode of the driving transistor from the light-emitting element, so that the light-emitting element does not emit light during the threshold compensation period and the data writing-in period.

* * * * *